US007530162B1

(12) United States Patent
Chuang

(10) Patent No.: US 7,530,162 B1
(45) Date of Patent: May 12, 2009

(54) T-BRACKET AND SPRING PLATE RIVETING MACHINE

(76) Inventor: Sen-Jung Chuang, No. 90-10, Hsia Kwei Jou San, Tan Shui Chen, Taipei County (TW)

( * ) Notice: Subject to any disclaimer, the term of this patent is extended or adjusted under 35 U.S.C. 154(b) by 952 days.

(21) Appl. No.: 11/086,397

(22) Filed: Mar. 23, 2005

(51) Int. Cl.
*B23P 21/00* (2006.01)

(52) U.S. Cl. ..... 29/788; 29/430; 29/525.06; 29/715; 29/796; 29/822

(58) Field of Classification Search ..... 29/430, 29/525.06, 712, 715, 788, 796, 822, 824
See application file for complete search history.

(56) References Cited

U.S. PATENT DOCUMENTS 3,755,871 A * 9/1973 Nelson, Jr. ..... 29/430
3,766,626 A * 10/1973 Mjos et al. ..... 29/34 R
4,306,348 A * 12/1981 Hang et al. ..... 29/432.2
4,586,253 A * 5/1986 Souchi et al. ..... 29/796
6,460,573 B1 * 10/2002 Fischer et al. ..... 138/109
7,165,304 B2 * 1/2007 Smith et al. ..... 29/430

* cited by examiner

*Primary Examiner*—David P Bryant
*Assistant Examiner*—Christopher M Koehler
(74) *Attorney, Agent, or Firm*—Troxell Law Office, PLLC

(57) ABSTRACT

A T-bracket and spring plate riveting machine for use with a T-bracket making machine is disclosed to have a conveyer for carrying T-brackets from the T-bracket making machine to a front side for processing, two pitch-adjustable riveting units for stamping metal sheet materials into spring plates and riveting two spring plates to the ends of each T-bracket, and sensor-controlled corrector frames for correcting the position of the T-bracket before riveting if necessary.

4 Claims, 27 Drawing Sheets

T-BRACKET AND SPRING PLATE RIVETING MACHINE

BACKGROUND AND SUMMARY OF THE INVENTION

The present invention relates to a riveting machine and more particularly, to a T-bracket and spring plate riveting machine for use with a T-bracket making machine to stamp metal sheet materials into spring plates and to automatically rivet two spring plates to the two distal ends of each T-bracket received from the T-bracket making machine.

A T-bracket 8 as shown in FIG. 1, comprises a bracket body 82 and two spring plates 81 at the ends of the bracket body 82. According to this design, the spring plates 81 are formed integral with the bracket body 82. Because the spring plates 81 and the bracket body 82 are formed of same material, the tensile strength of the T-bracket 8 is insufficient. FIG. 2 shows another design of T-bracket 2, which has two spring plates 601 riveted to the two ends. This design of T-bracket 2 has a high tensile strength. However, because the spring plates 601 are riveted to the T-bracket 2 by labor, the fabrication of this design of T-bracket requires much time and labor, resulting in a high manufacturing cost.

The present invention has been accomplished under the circumstances in view. It is therefore the main object of the present invention to provide a T-bracket and spring plate riveting machine, which directly carries a T-bracket from a T-bracket making machine forwards and automatically riveting the T-bracket with two spring plates. It is another object of the present invention to provide a T-bracket and spring plate riveting machine, which uses two riveting units for riveting spring plates to a T-bracket, and the pitch between the two riveting units is adjustable subject to the size of the T-bracket used. It is still another object of the present invention to provide a T-bracket and spring plate riveting machine, which uses sensors to detect the position of the T-bracket to be processed, and two corrector frames to correct the position of the T-bracket if the T-bracket is held in a wrong direction.

DETAILED DESCRIPTION OF THE INVENTION

Figure 1:
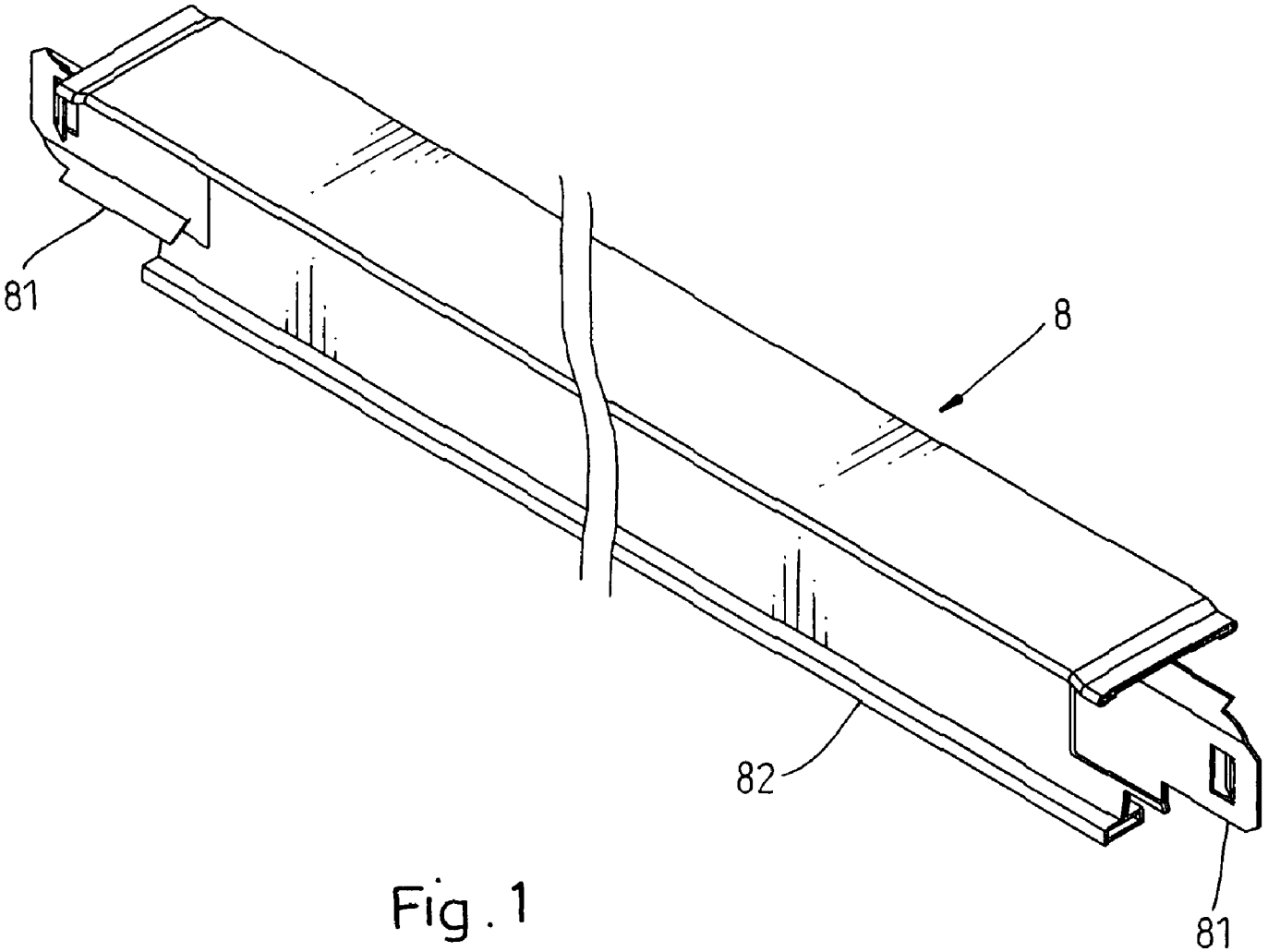
FIG. 1 illustrates an integrated form of T-bracket.
Figure 2:
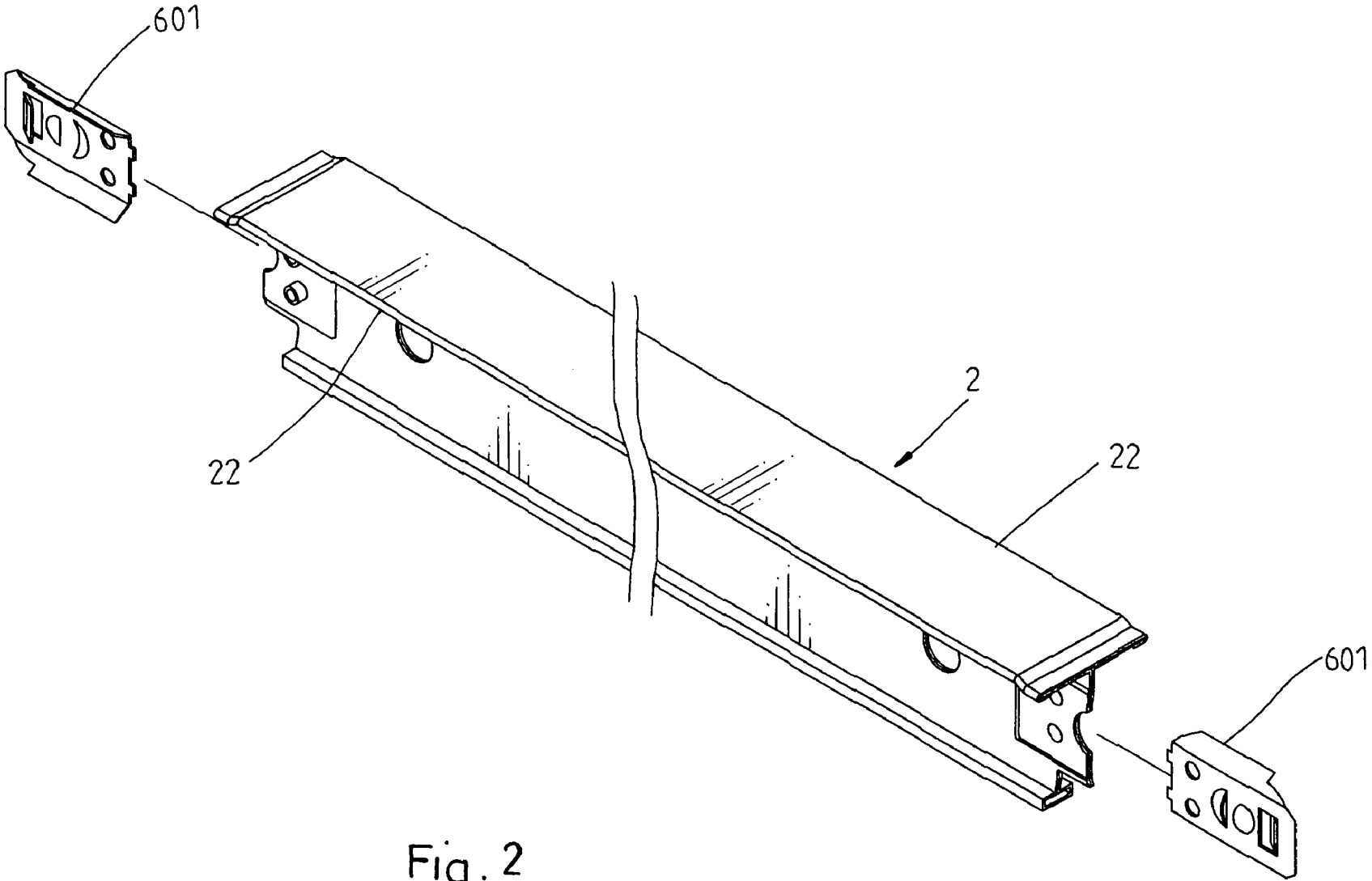
FIG. 2 is an exploded view of another design of T-bracket.

Referring to FIGS. 4~14, a T-bracket and spring plate riveting machine 3 is used with a T-bracket making machine 1 and controlled to riveting two spring plates to the two distal ends of a T-bracket. The T-bracket making machine 1 comprises a blank bracket body making unit 11 and a bracket processing unit 12. The blank bracket body making unit 11 is controlled to process a metal plate material (not shown) into a blank bracket body 20 (see FIG. 5). The bracket processing unit 12 comprises a base 121, a work table 122, and a conveyer 123. The conveyer 123 is provided at the top side of the base 121 and adapted to carry the blank bracket body 20 from the blank bracket body making unit 11 forwards for processing. The work table 122 is movably provided at the top side of the base 121 over the conveyer 123, having a stamping mechanism (not shown) adapted to process the blank bracket body 20 into a T-bracket 2 (see also FIG. 2), allowing the T-bracket 2 to be further carried by the conveyer 123 to the T-bracket and spring plate riveting machine 3.

Figure 3:
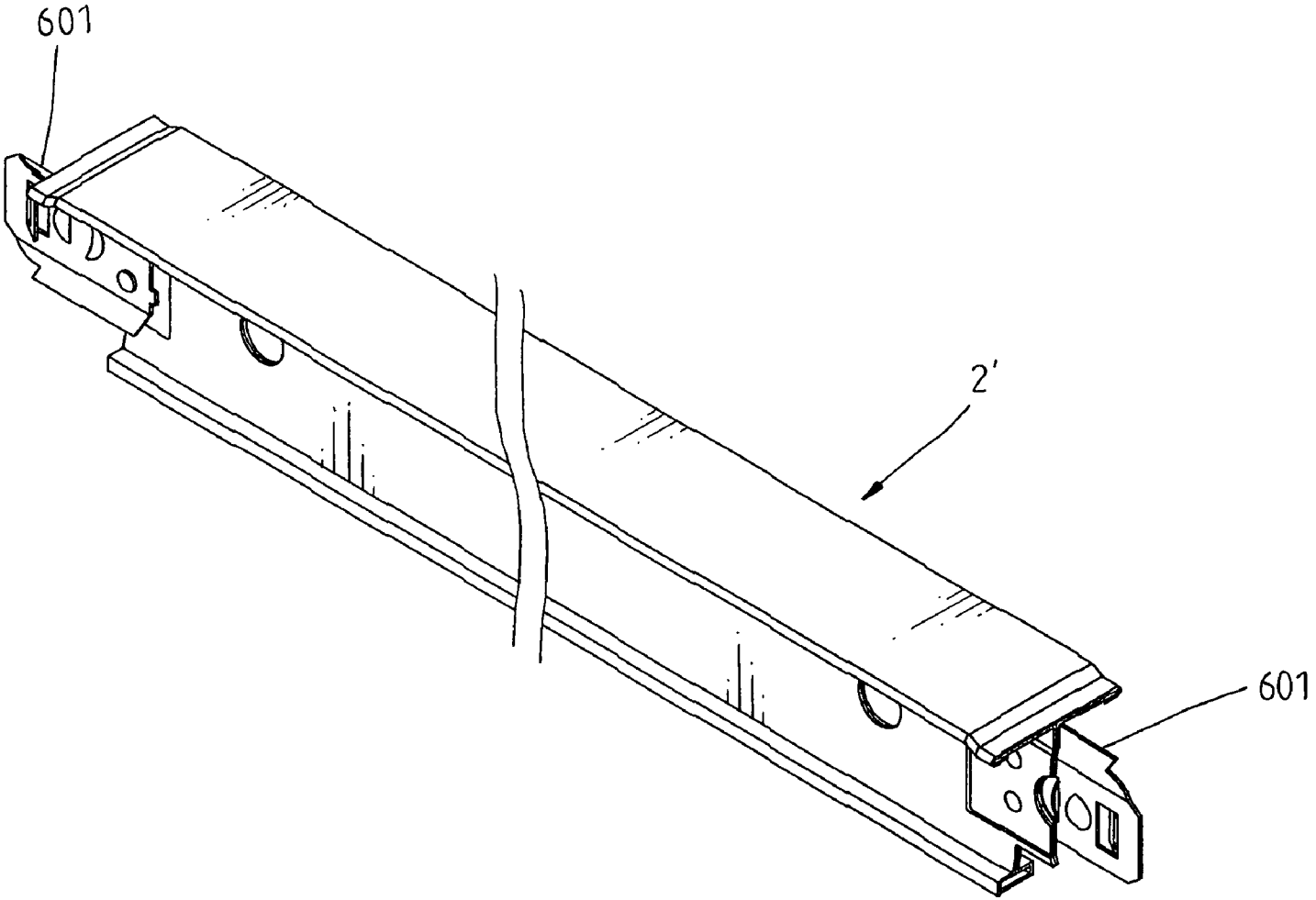
FIG. 3 is an elevational assembly view of FIG. 2.
Figure 4:
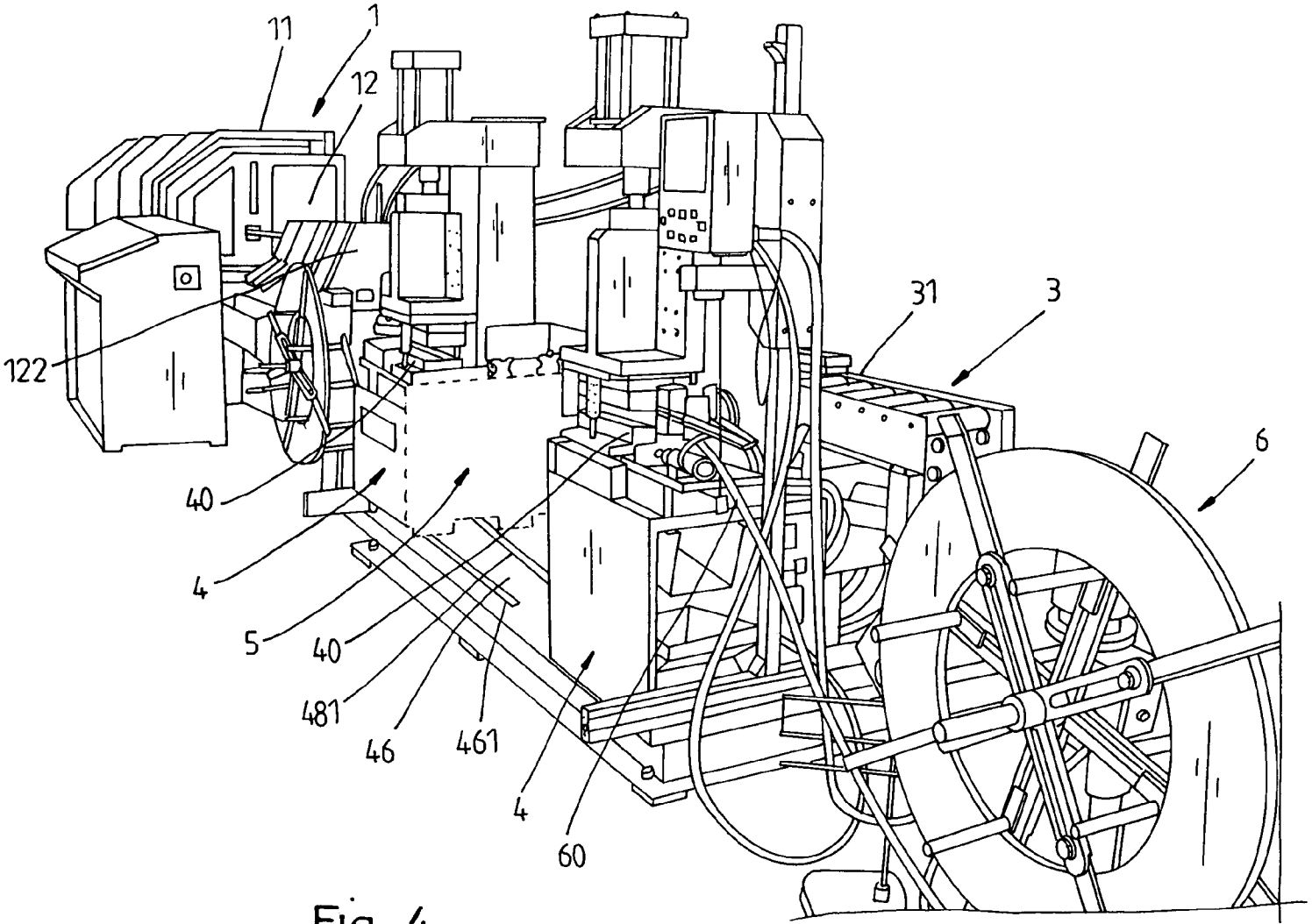
FIG. 4 is a perspective view showing a T-bracket and spring plate riveting machine linked to a T-bracket making machine according to the present invention.
Figure 5:
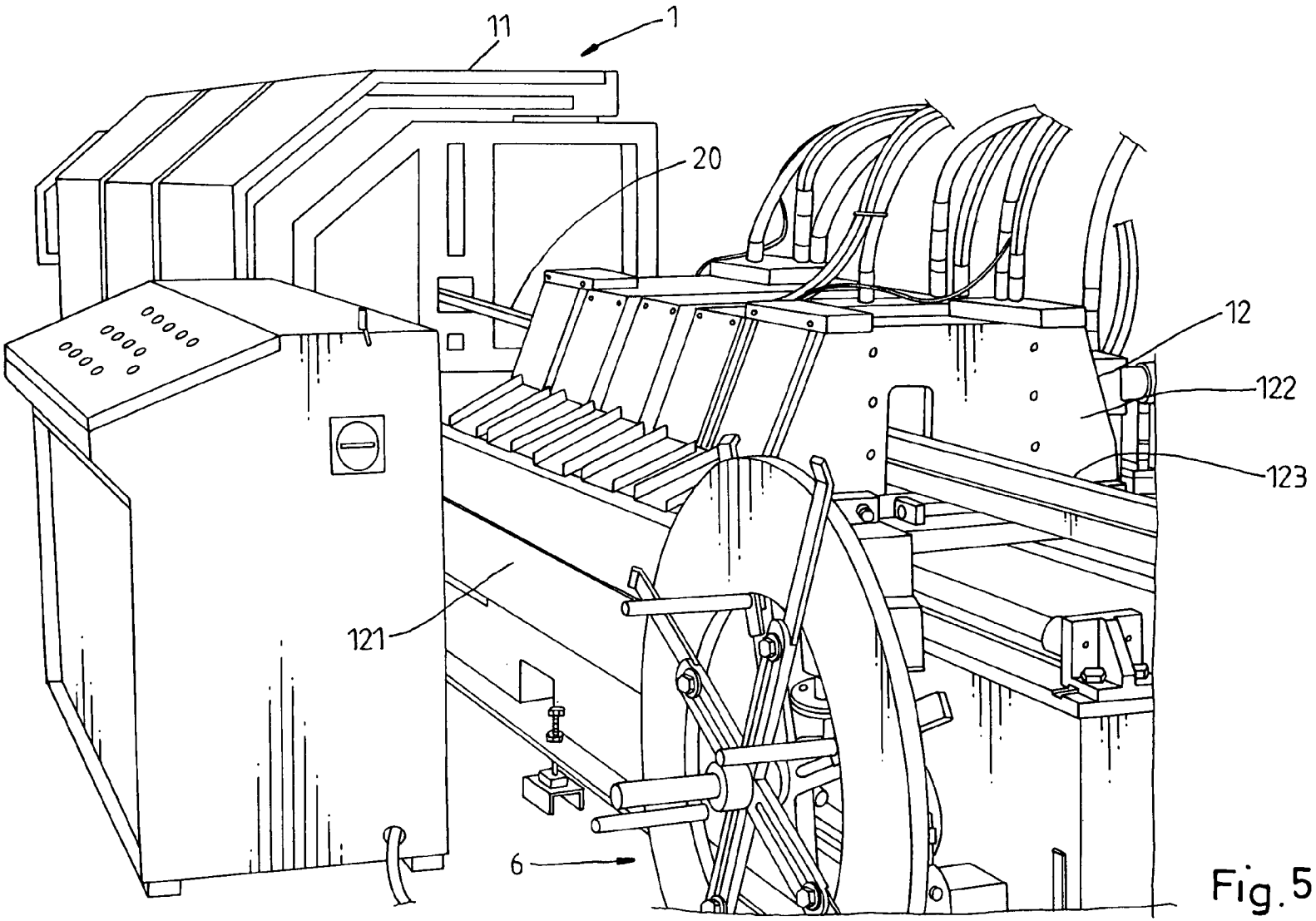
FIG. 5 is an enlarged view of a part of the present invention.
Figure 6:
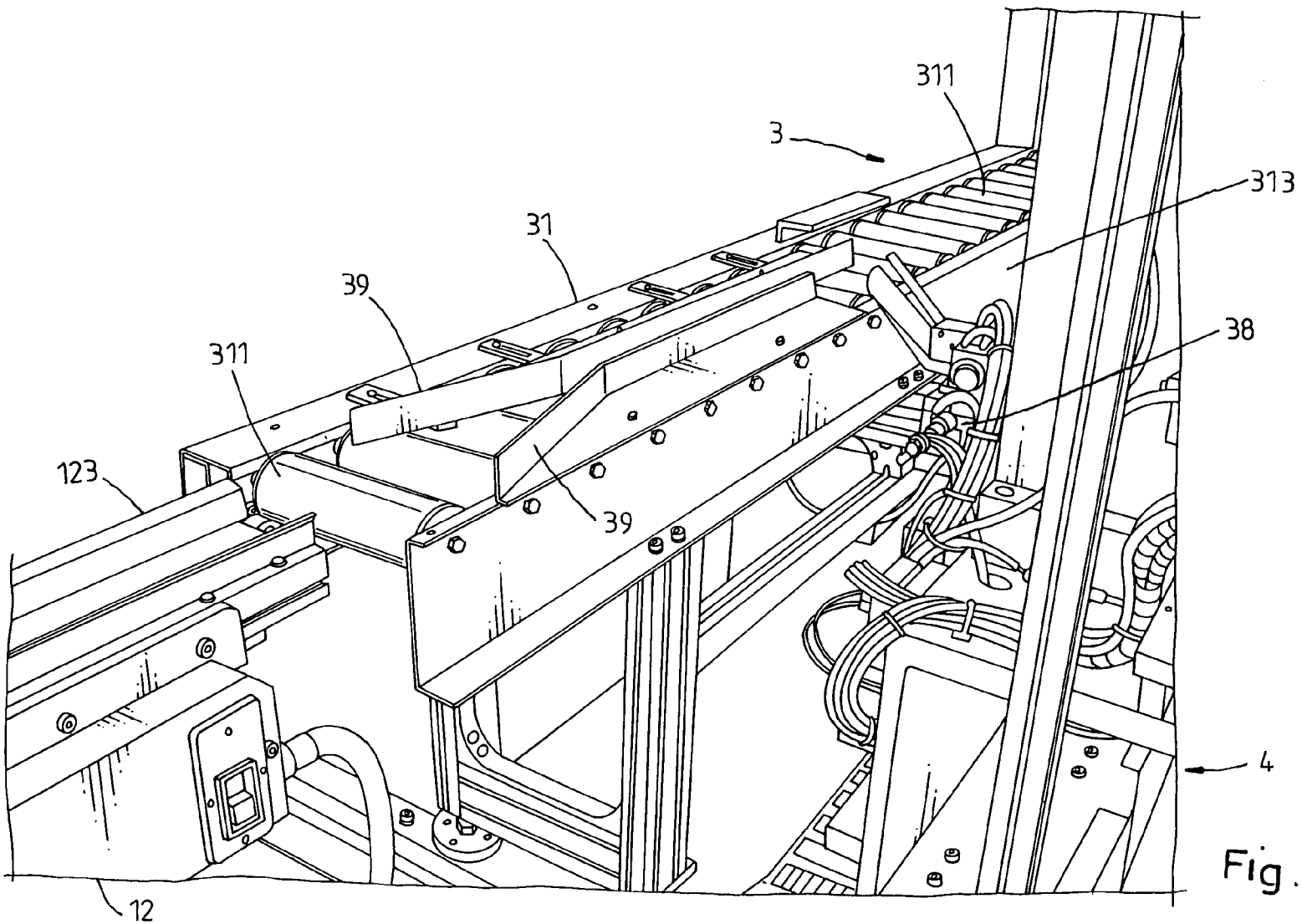
FIG. 6 is an enlarged view of another part of the present invention.
Figure 7:
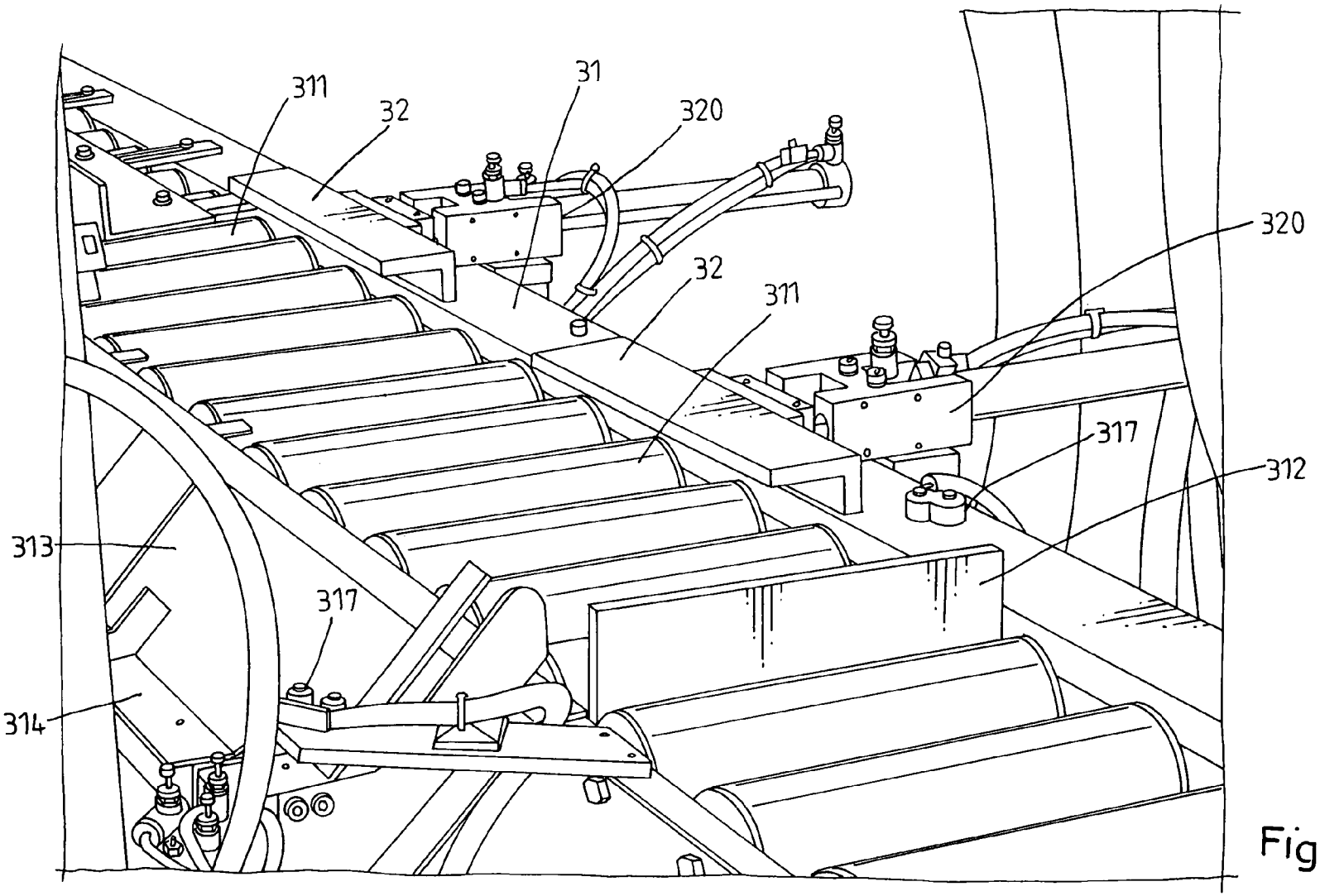
FIG. 7 is an enlarged view of still another part of the present invention.
Figure 8:
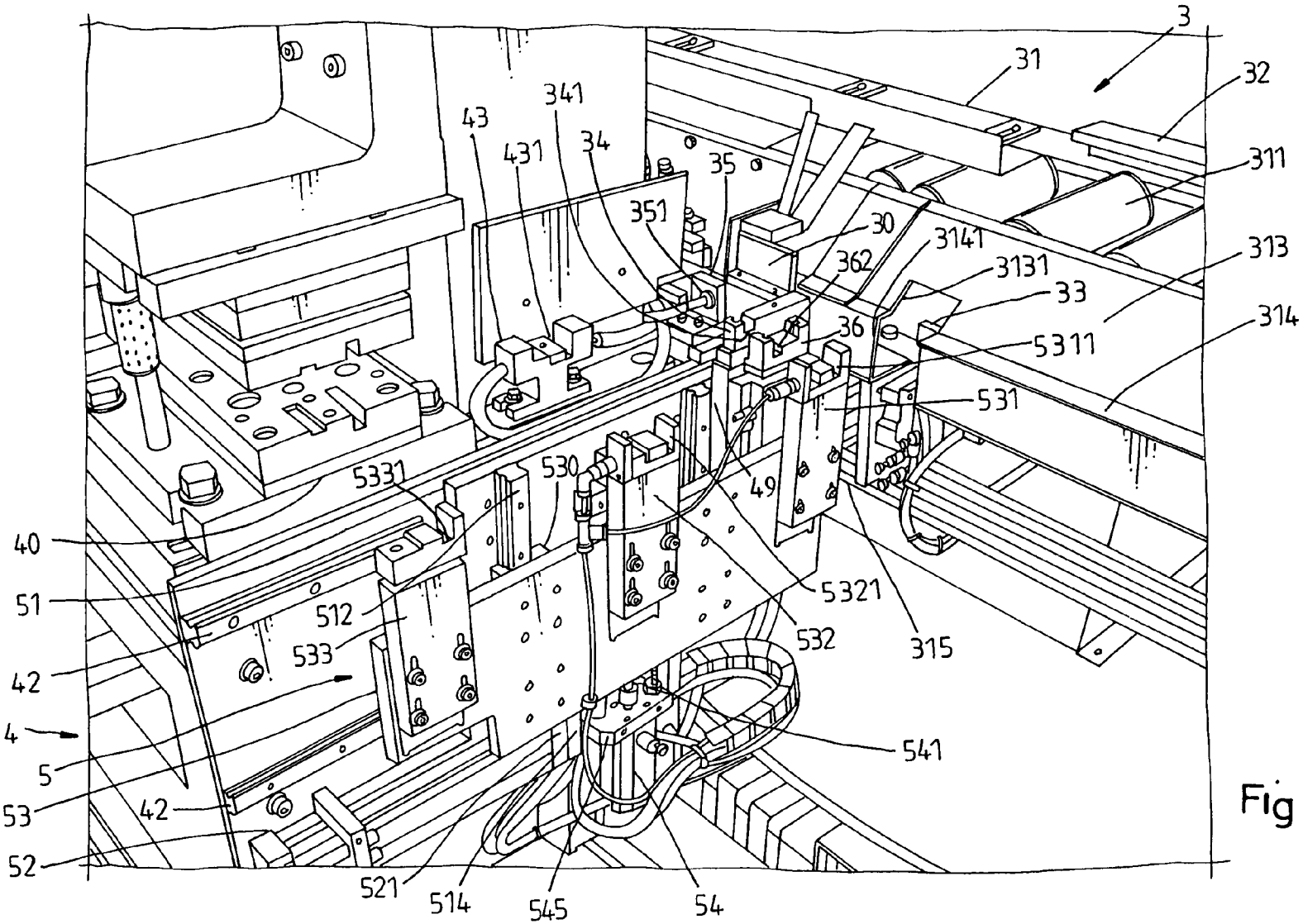
FIG. 8 is an enlarged view of still another part of the present invention.
Figure 9:
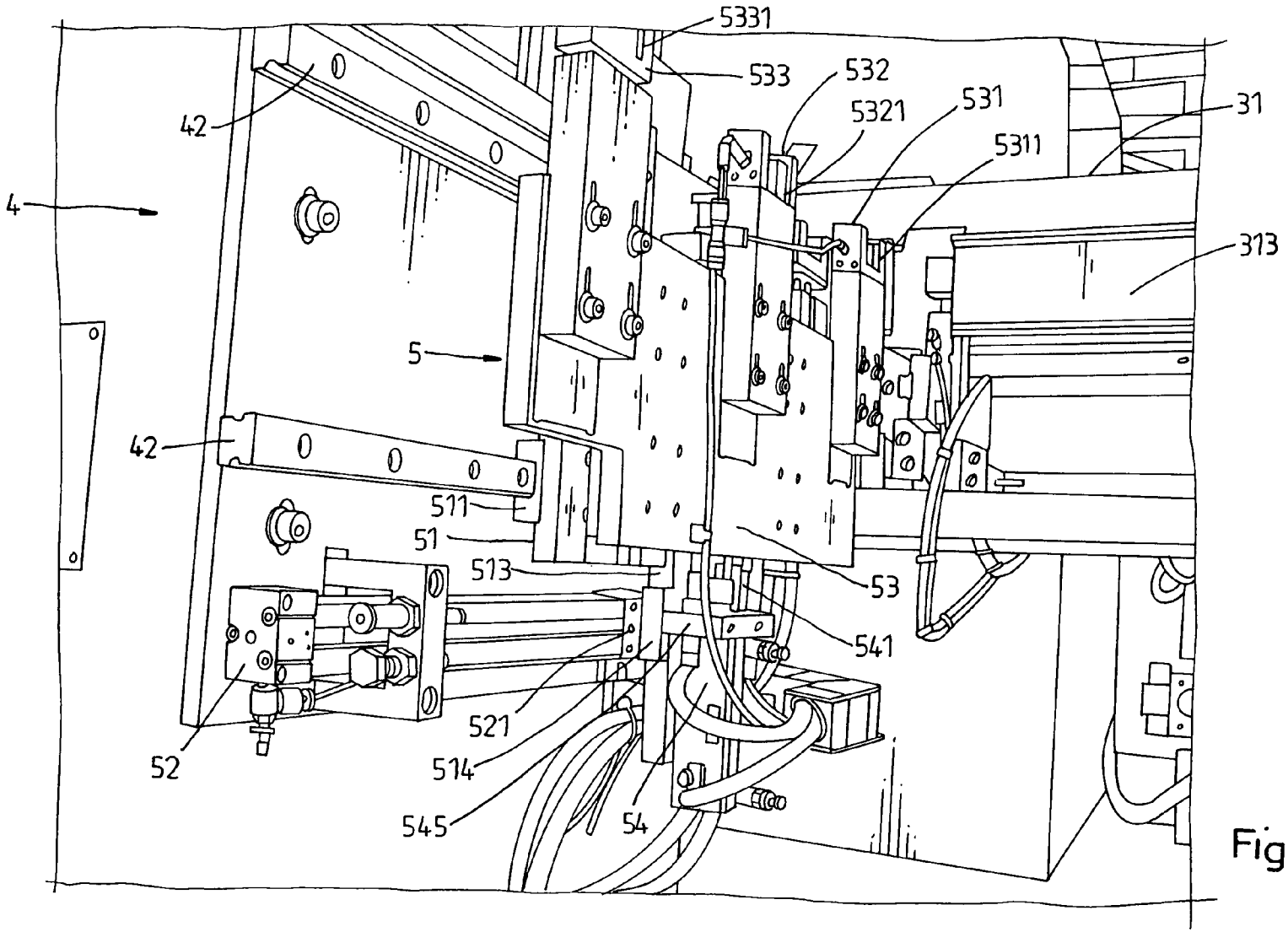
FIG. 9 is an enlarged view of still another part of the present invention.
Figure 10:
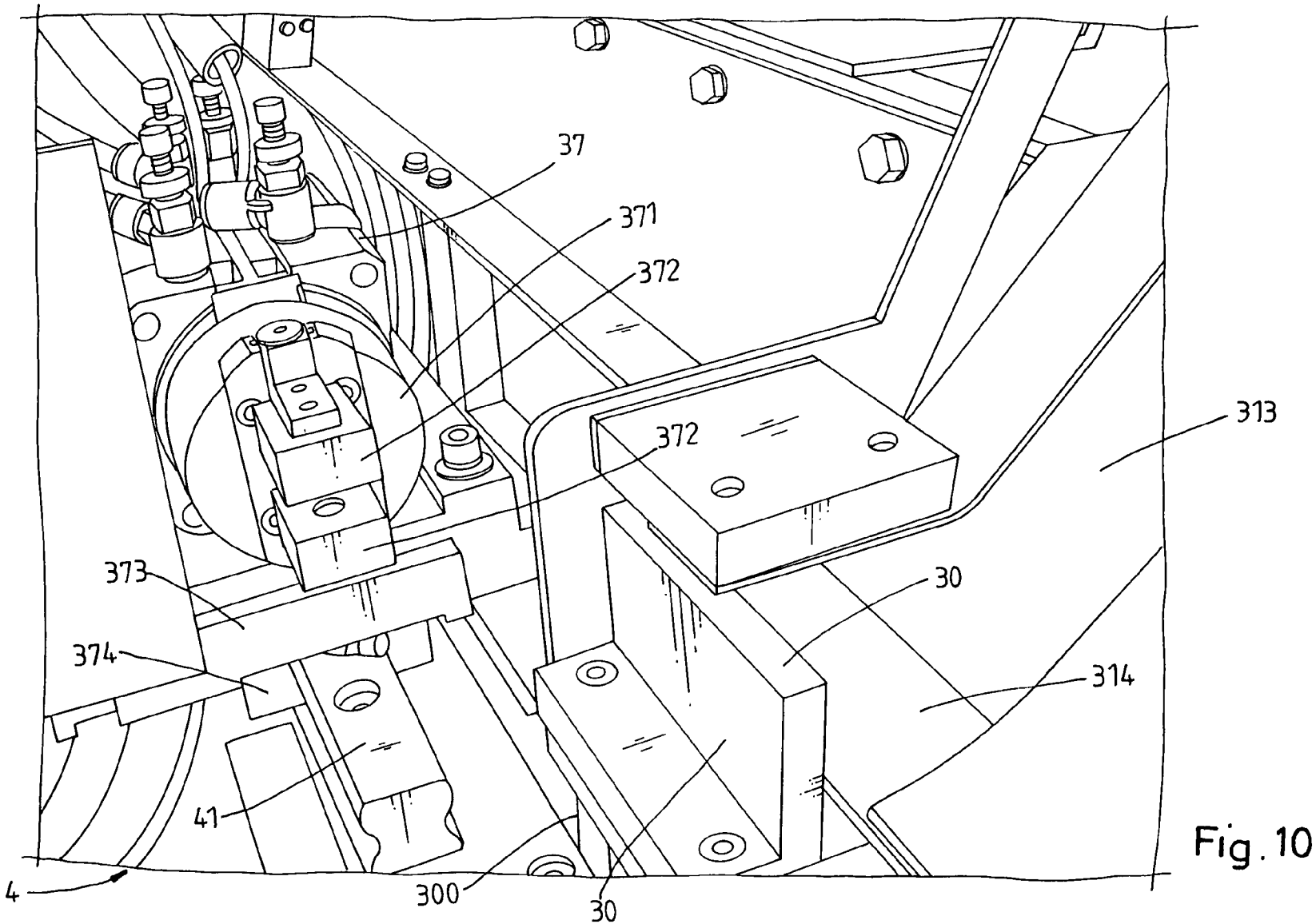
FIG. 10 is an enlarged view of still another part of the present invention.
Figure 11:
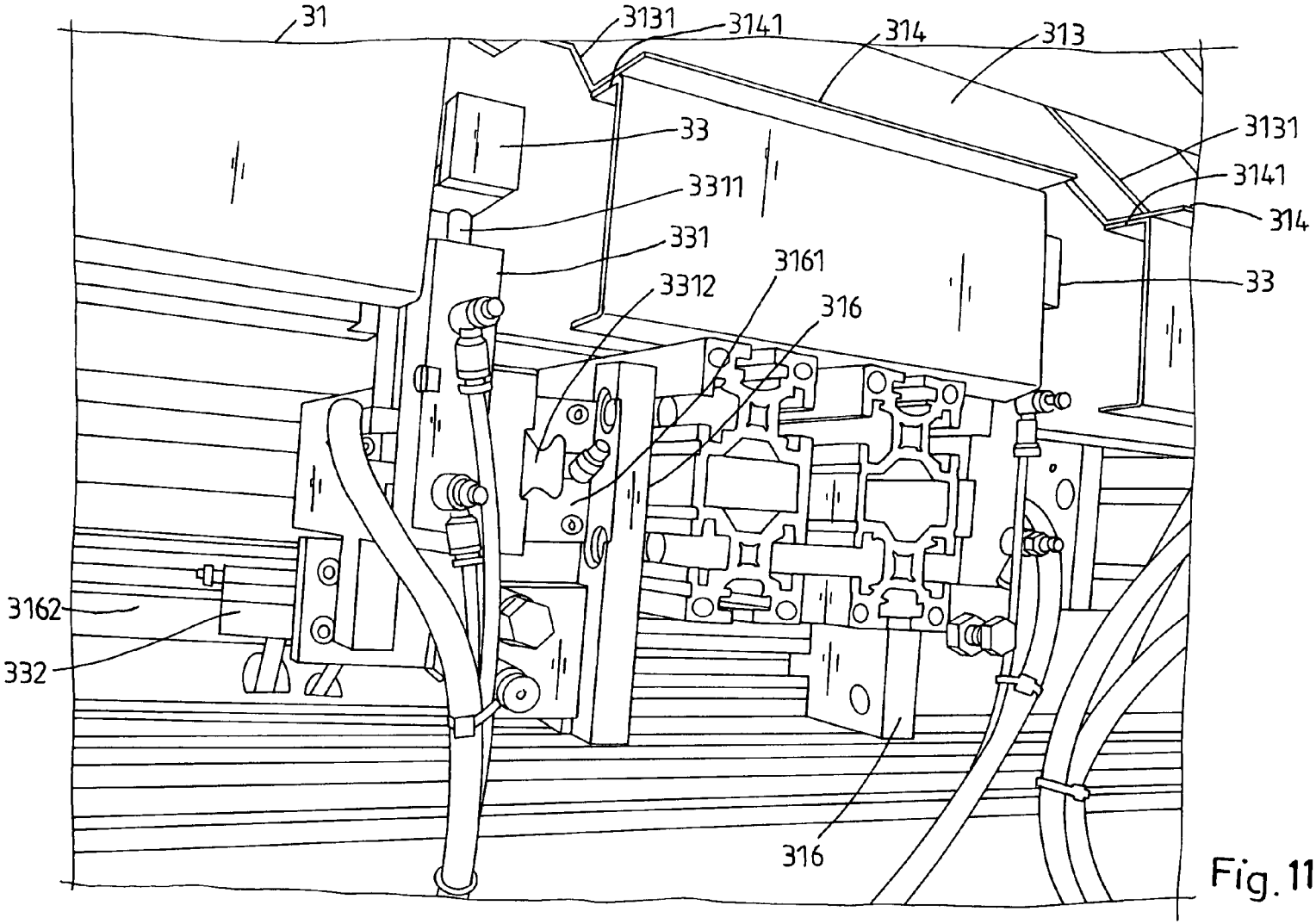
FIG. 11 is an enlarged view of still another part of the present invention.
Figure 12:
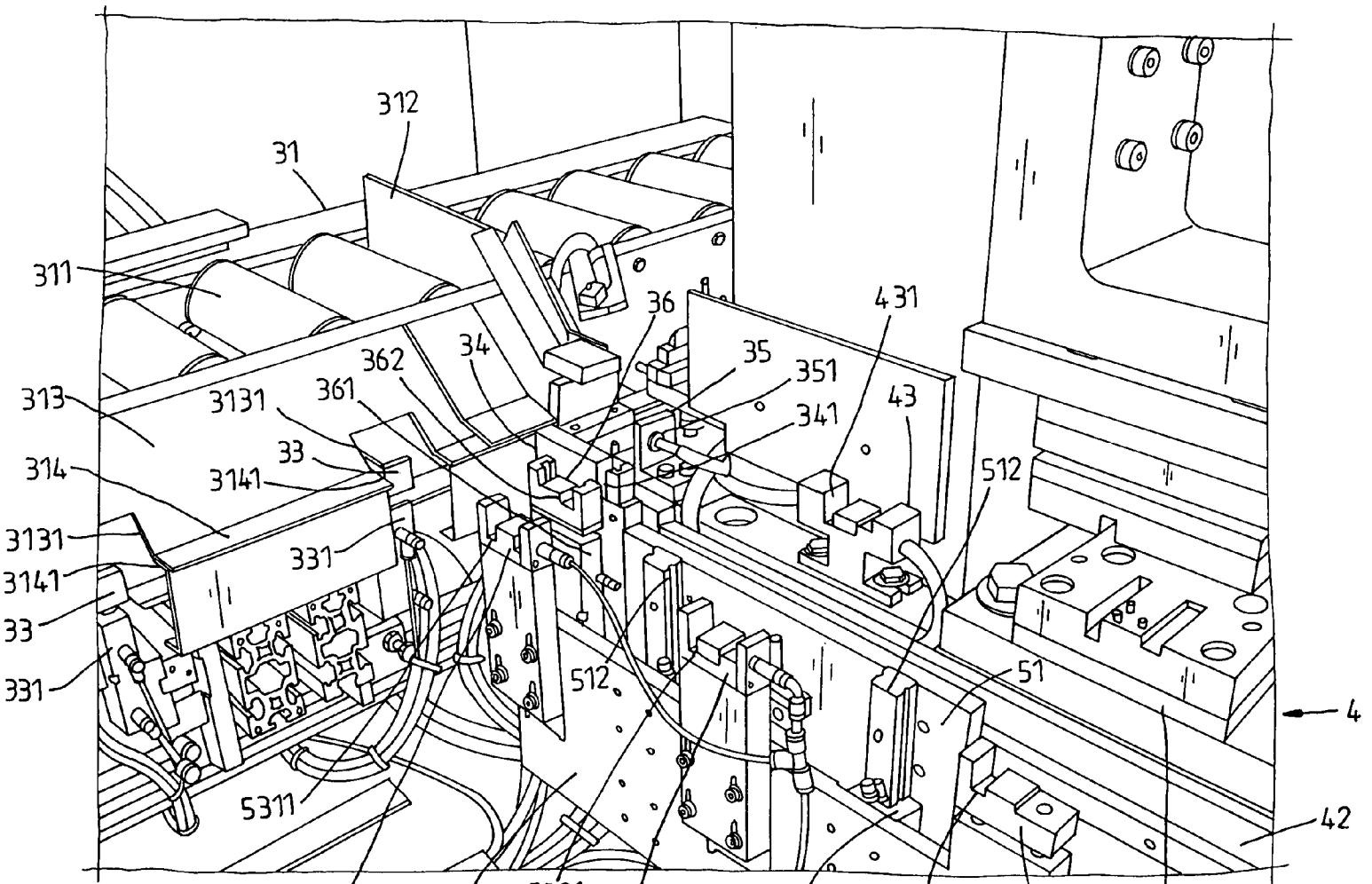
FIG. 12 is an enlarged view of still another part of the present invention.
Figure 17:
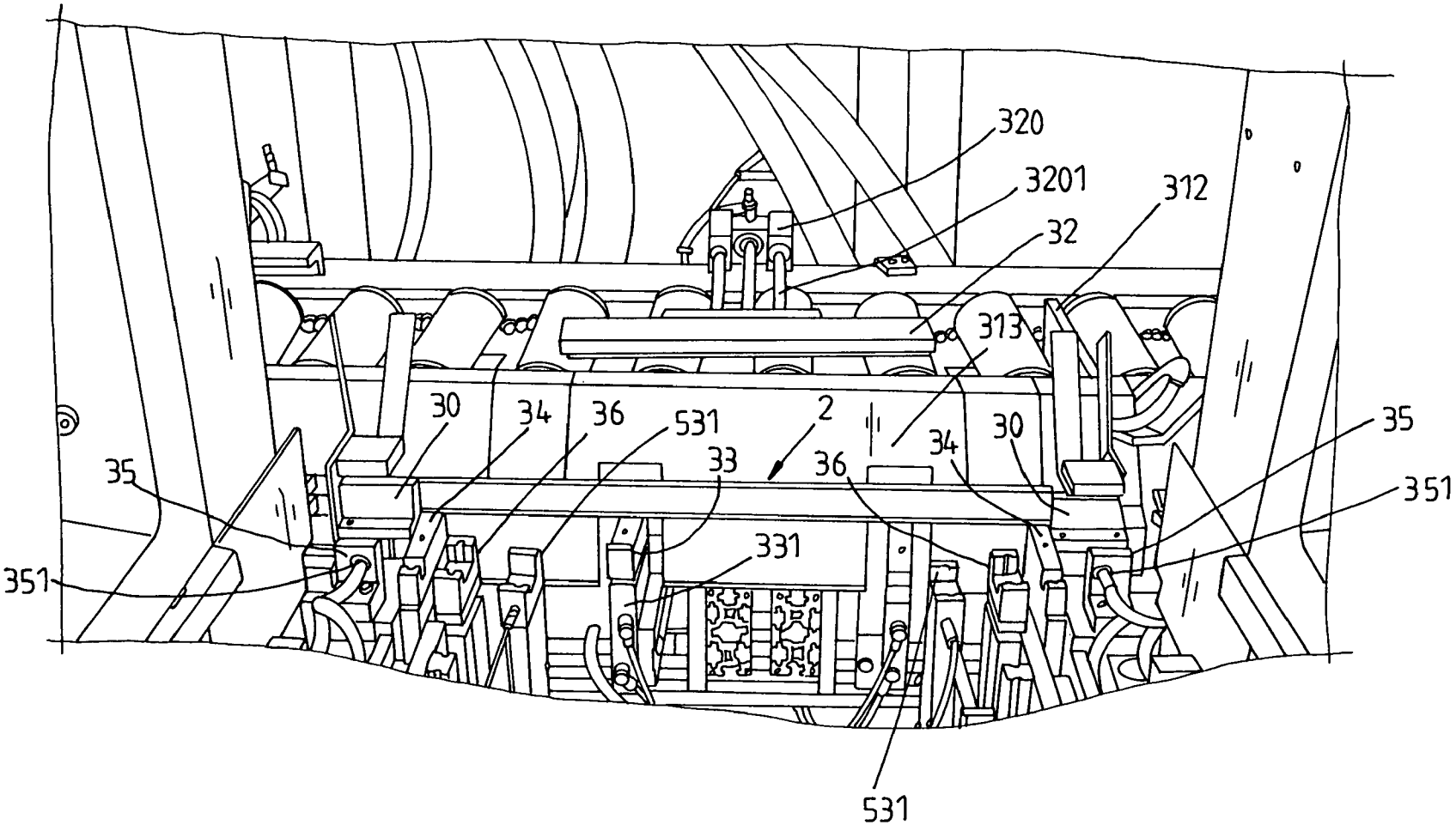
FIG. 17 corresponds to FIG. 16, showing another action of the T-bracket and spring plate riveting machine.
Figure 24:
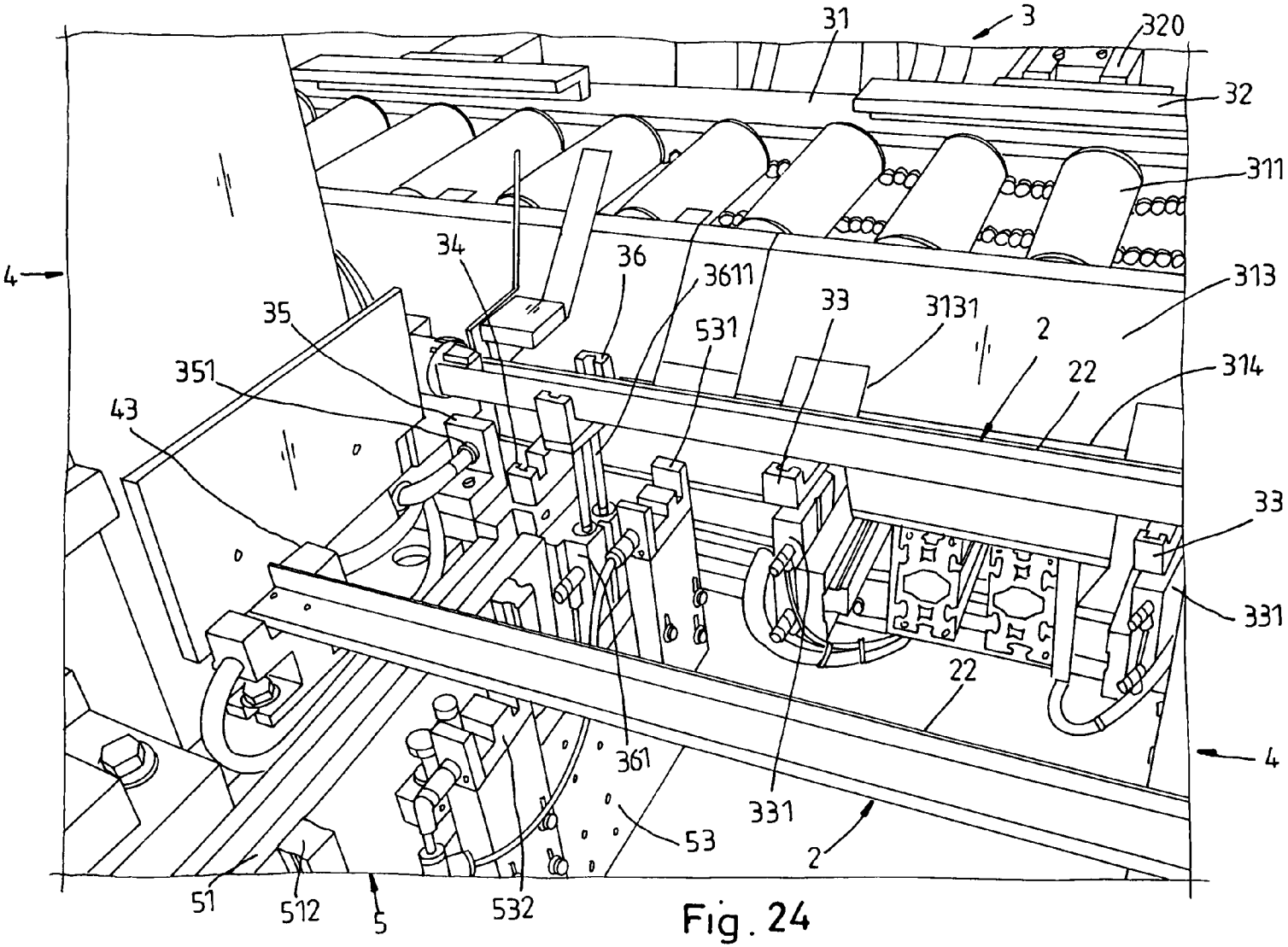
FIG. 24 corresponds to FIG. 23, showing the incorrectly positioned T-bracket lifted.

The T-bracket and spring plate riveting machine 3 comprises:

a conveyer 31, which comprises a plurality of transversely extending rollers 311 adapted to carry the finished T-bracket 2 from the conveyer 123 of the bracket processing unit 12 forward for processing, a stop block 312 at one end remote from the bracket processing unit 12, a sloping wall 313 at one lateral side near the stop block 312, and a collector frame 314 at the bottom side of the sloping wall 313 (see FIGS. 7 and 8);

two first air cylinders 320 provided at one lateral side of the conveyer 123 opposite to the sloping wall 313 (see FIG. 7);

two material push bars 32 respectively fastened to the reciprocating rods 3201 of the first air cylinders 320 and movable with the reciprocating rods 3201 to push the conveyed T-bracket 2 away from the conveyer 123 to the collector frame 314 at the bottom side of the sloping wall 313 (see FIG. 17);

sensors 317 provided at the conveyer 31 and adapted to detect the presence of the conveyed T-bracket 2 at the conveyer 123 and to control the operation of the air cylinders 320 subject to the detection result (see FIG. 7);

two second air cylinders 300 respectively fixedly provided at a first bottom frame 315 of the conveyer 31;

two material stopper frames 30 respectively fixedly fastened to the reciprocating rods (not shown) of the second air cylinders 300 and movable with the reciprocating rods of the second air cylinders 300 for stopping the received T-bracket 2 at the collector frame 314 (see FIGS. 8, 10, 12, 16);

a plurality of third air cylinders 331, each having a vertically extending reciprocating rod 3311;

a plurality of carriers 33 respectively fixedly fastened to the reciprocating rods 3311 of the third air cylinders 331 below respective openings 3131, 3141 at the collector frame 314 (see FIG. 11);

rails 3312 provided at one side relative to the third air cylinders 331;

sliding blocks 3161 respectively provided at a second bottom frame 316 of the conveyer 31 and coupled to the rails 3312;

a plurality of fourth air cylinders 332 fastened to one side 3162 of the second bottom frame 316 of the conveyer 31 and having the respective reciprocating rods (not shown) respectively connected to the third air cylinders 331 for moving the third air cylinders 331 horizontally inwards/outwards (see FIG. 11);

two riveting units 4 each of which comprising a pair of longitudinal rails 41, a pair of transverse rails 42, and a stamping mold 40 for stamping a metal sheet material 60 into spring plates 601 (see FIG. 2) and riveting spring plates 601 to T-brackets 2 (see FIG. 3);

two receiver frames 34 respectively fixedly fastened to a respective locating plate 49 in each of the riveting units 4 for receiving the T-bracket 2 carried by the carriers 33, each having a positioning slot 341 for holding a top wall 22 of the T-bracket 2 in proximity to two sensor holders 35 (see FIGS. 8 and 12);

two sensor holders 35 each having a sensor 351 for detecting the position of the T-bracket 2 at the receiver frames 34 and for driving two corrector frames 36 to correct the position of the T-bracket 2;

two corrector frames 36 adapted to correct the position of the T-bracket 2 at the receiver frames 34, each having a slot 362 for receiving the T-bracket 2;

two fifth air cylinders 361 respectively fixedly mounted on the riveting units 4, each having a reciprocating rod 3611 respectively connected to the corrector frames 36 (see FIG. 24) for moving the corrector frames 36 to correct the position of the T-bracket 2 at the receiver frames 34;

two rotary drives 37 fixedly fastened to a respective holder frame 373, which has a coupling 374 slidably coupled to the longitudinal rails 41 at the riveting units 4 and is movable by a reciprocating device 38 along the longitudinal rails 41 (see FIG. 10) each comprising a rotary head 371 rotatable through 180° within two reversed directions, and a chuck 372 provided at the rotary head 371 for clamping the workpiece;

two work frame units 5 each of which comprising a base frame 51, a slide 511 fixedly provided at the back side of the base frame 51 and coupled to the transverse rails 42 of the riveting units 4, a connecting block 514 fixedly provided at the bottom side 513 of the base frame 51, a horizontal driving cylinder 52, which has a reciprocating rod 521 connected to the connecting block 514 for moving the base frame 51 along the transverse rails 42 (see FIG. 9), a pair of vertical rails 512 fixedly provided at the front side of the base frame 51, a second frame 53, a slide 530 fixedly provided at the back side of the second frame 53 and coupled to the vertical rails 512, a vertical driving cylinder 54, which has a locating block 545 connected to the connecting block 514 of the base frame 51 and a reciprocating rod 541 connected to the bottom side of the second frame 53 for moving the second frame 53 along the vertical rails 512, and three bearing frames, namely, the first bearing frame 531, the second bearing frame 532 and the third bearing frame 533 respectively fastened to the front side of the second frame 53 at the top and arranged in parallel, which bearing frames 531~533 each having a locating opening 5311, 5321, 5331 for the positioning of the top wall of the T-bracket 2;

two supplementary frames 43 respectively fastened to the riveting units 4 at two sides for receiving the T-bracket 2 from the second bearing frame 532 of each of the work frame units 5, each supplementary frame 43 having a locating opening 431 for the positioning of the top wall 22 of the received bracket 2; and two material feeders 6 (see FIG. 4) adapted to feed a respective roll of metal sheet material 60 to the stamping mold 40 of the riveting unit 4 for stamping into spring plates 601 for riveting to the received T-bracket 2 to form the desired finished product 2' (see FIG. 3).

Figure 13:
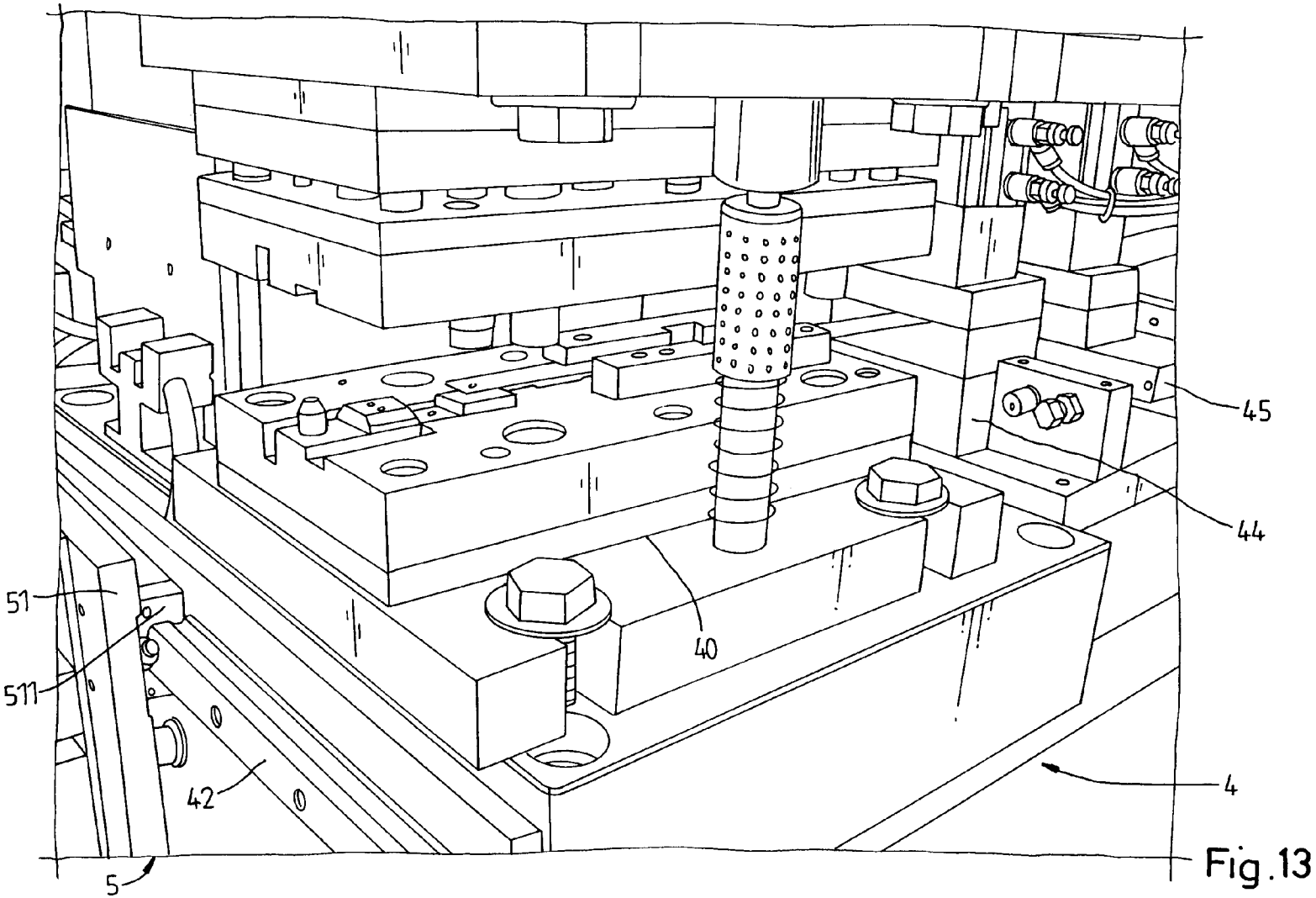
FIG. 13 is an enlarged view of still another part of the present invention.
Figure 14:
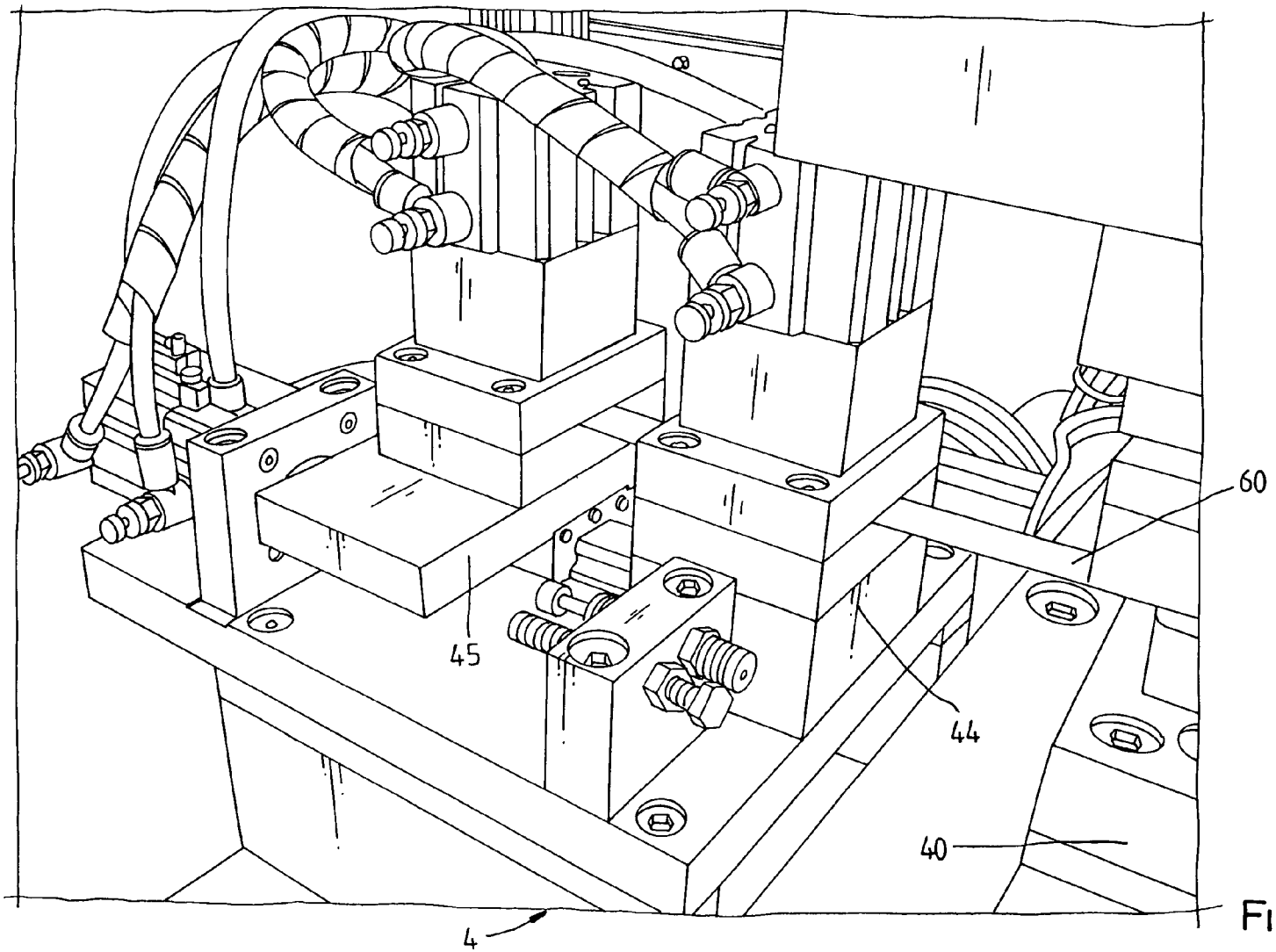
FIG. 14 is an enlarged view of still another part of the present invention.

Referring to FIGS. 13 and 14, each riveting unit 4 further comprises a clamp 44 for holding down the respective metal sheet material 60 for stamping by the respective stamping mold 40 positively, and a material guide 45 for guiding the respective metal sheet material 60 toward the respective stamping mold 40 for processing.

The conveyer 31 has a curved front guide board 39 (see FIG. 6) for guiding the T-bracket 2 forwards for further processing.

Figure 15:
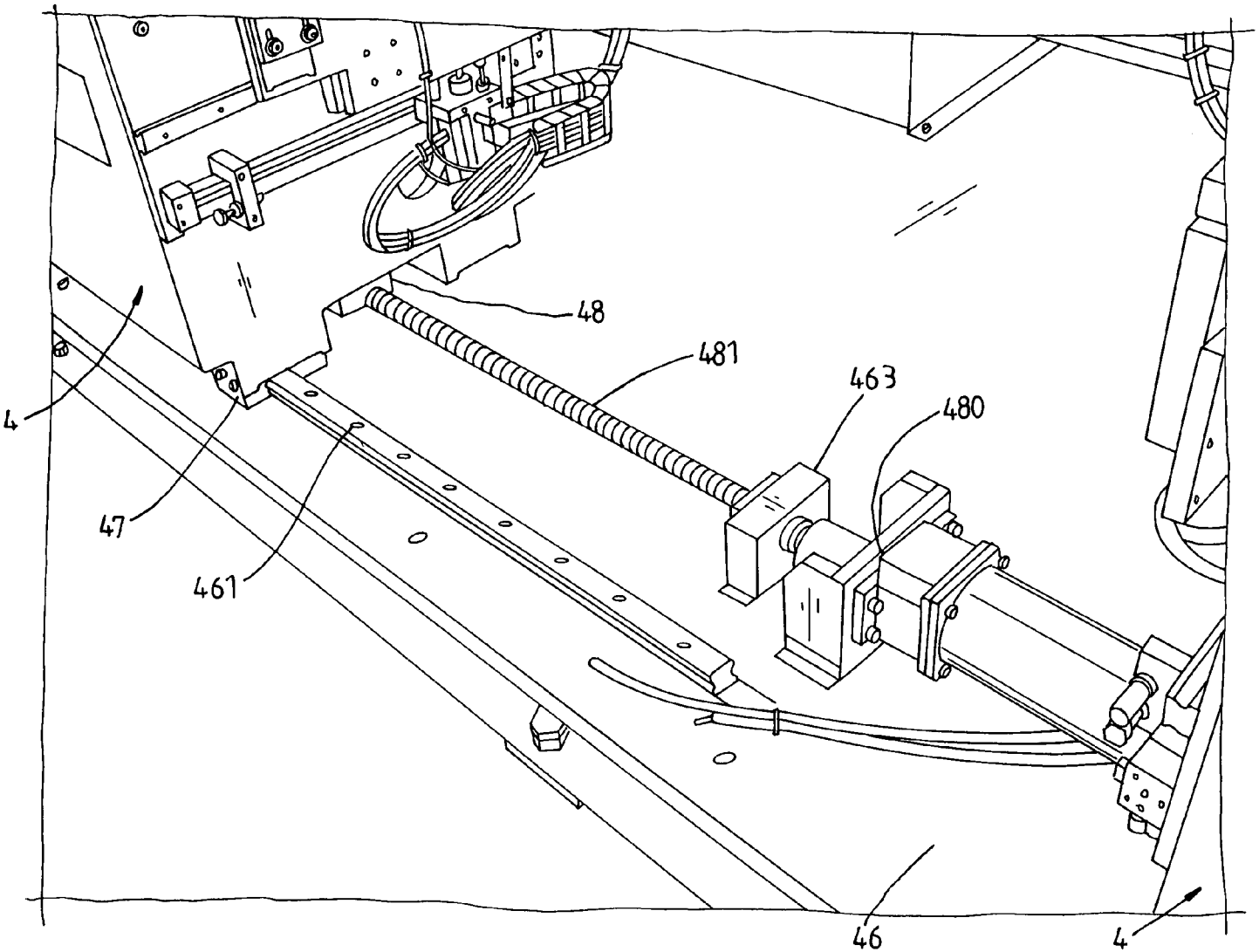
FIG. 15 is an enlarged view of still another part of the present invention.

Referring to FIG. 15, one of the two riveting units 4 has the bottom side directly connected to the bottom frame 46; the other of the two riveting units 4 has a slide 47 fixedly provided at the bottom side and coupled to a pair of rails 461 at the bottom frame 46 and a guide block 48 fixedly provided at the bottom side. A screw rod 481 is threaded through the guide block 48, having one end threaded into a locating block 463 and the other end coupled to a speed-reduction motor 480. When started the speed-reduction motor 480, the screw rod 481 is rotated to move the guide block 48 of the respective riveting unit 4 along the rails 461, thereby adjusting the distance between the two riveting units 4 subject to the size of the T-bracket 2 to be processed.

Figure 27:
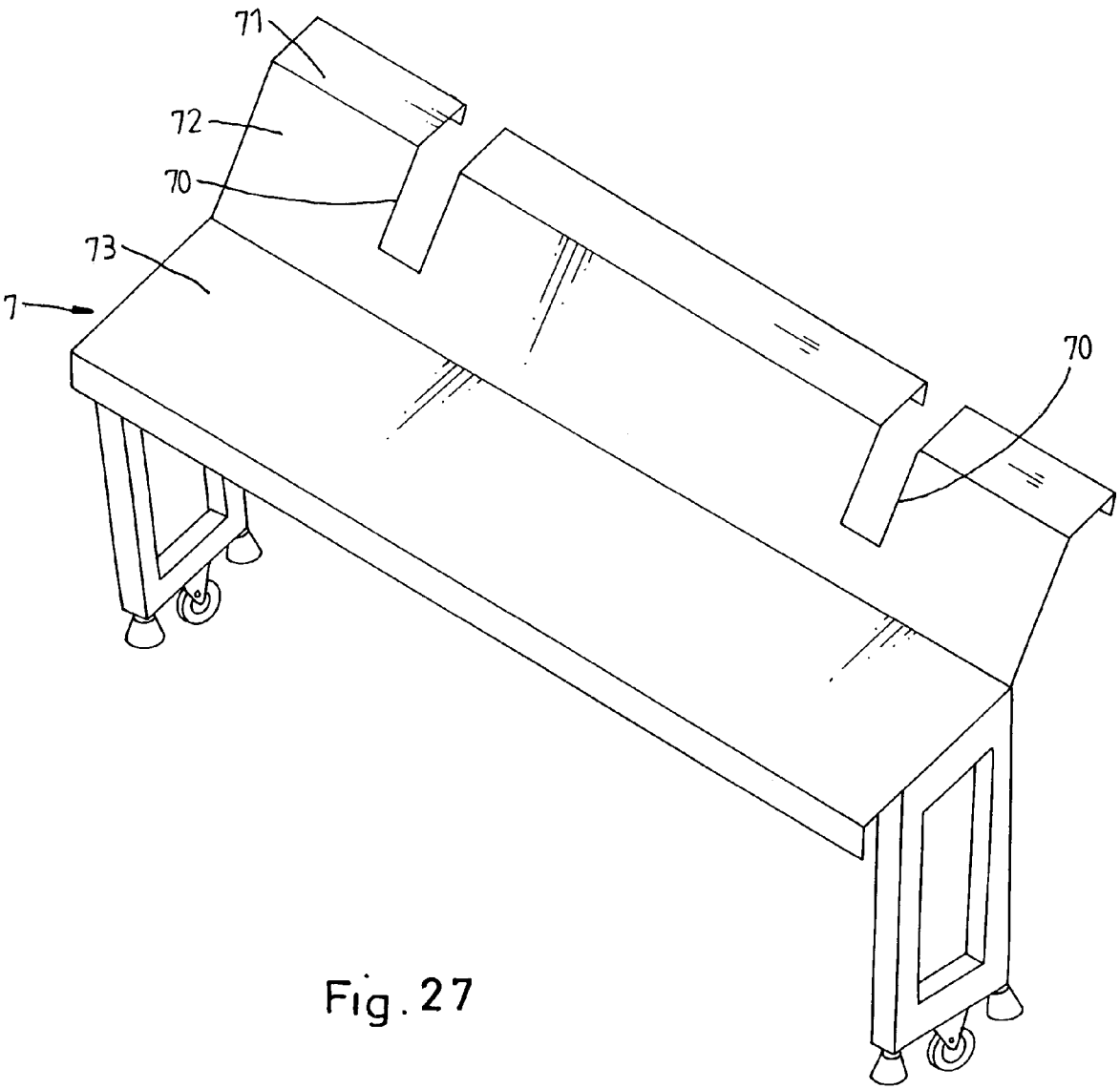
FIG. 27 is an elevational view of a collector frame for the T-bracket and spring plate riveting machine according to the present invention.

Referring to FIG. 27, a collector frame 7 is provided at a suitable location spaced from one side of the riveting units 4 at a distance. The collector frame 7 has a top receiving face 71, a sloping guide face 72 extending from one side of the top receiving face 71, a plurality of openings 70 transversely cut through the top receiving face 71 and extending to the sloping guide face 72 at a distance for receiving the third bearing frames 533 of the second frames 53 of the work frame units 5 for enabling the T-bracket 2 to be received by the top receiving face 71 upon down stroke of the third bearing frames 533 relative to the collector frame 7, and a collector base 73 at the bottom side of the sloping guide face 72.

Figure 16:
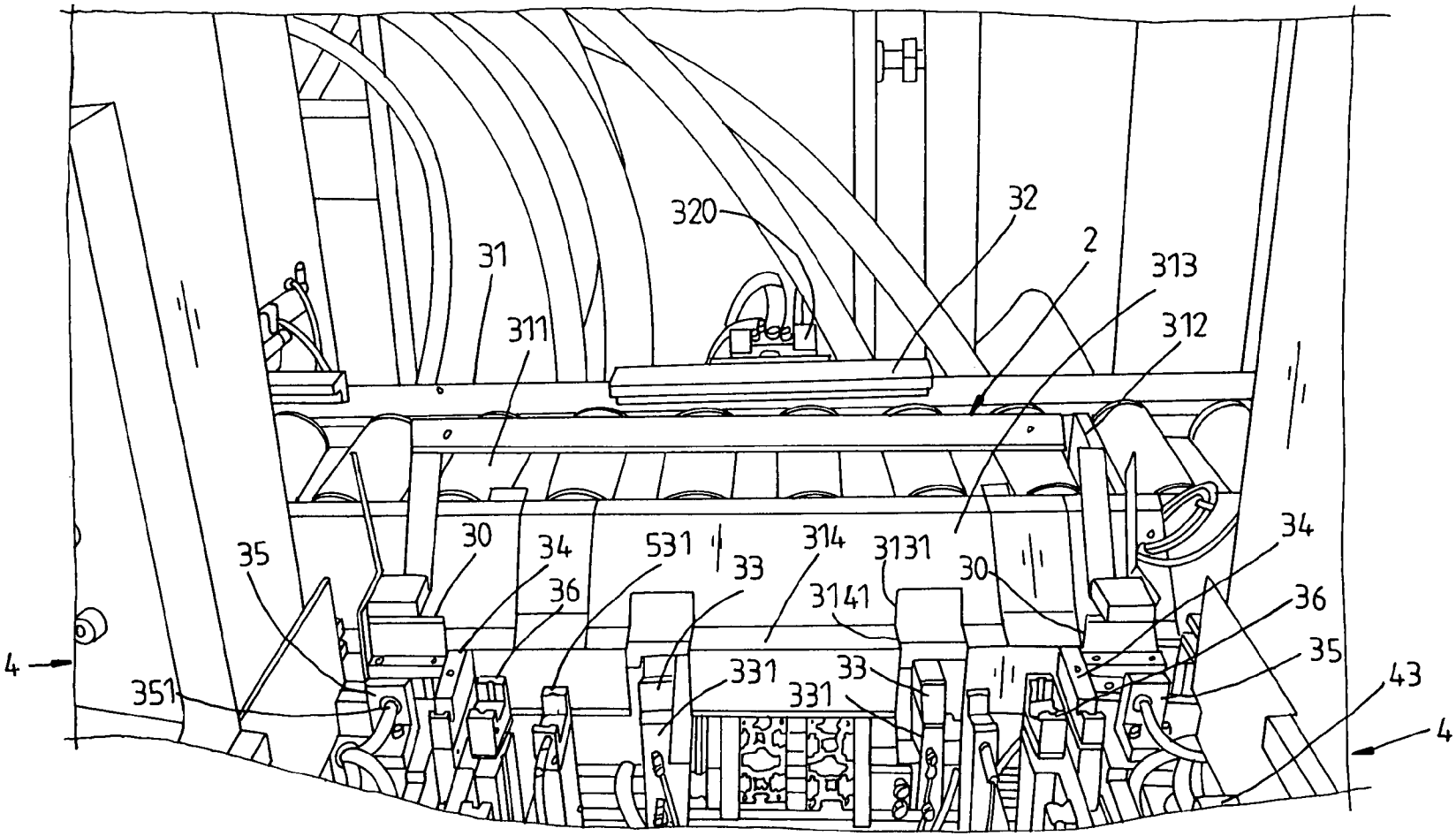
FIG. 16 is an enlarged view of still another part of the present invention, showing an action of the T-bracket and spring plate riveting machine.
Figure 18:
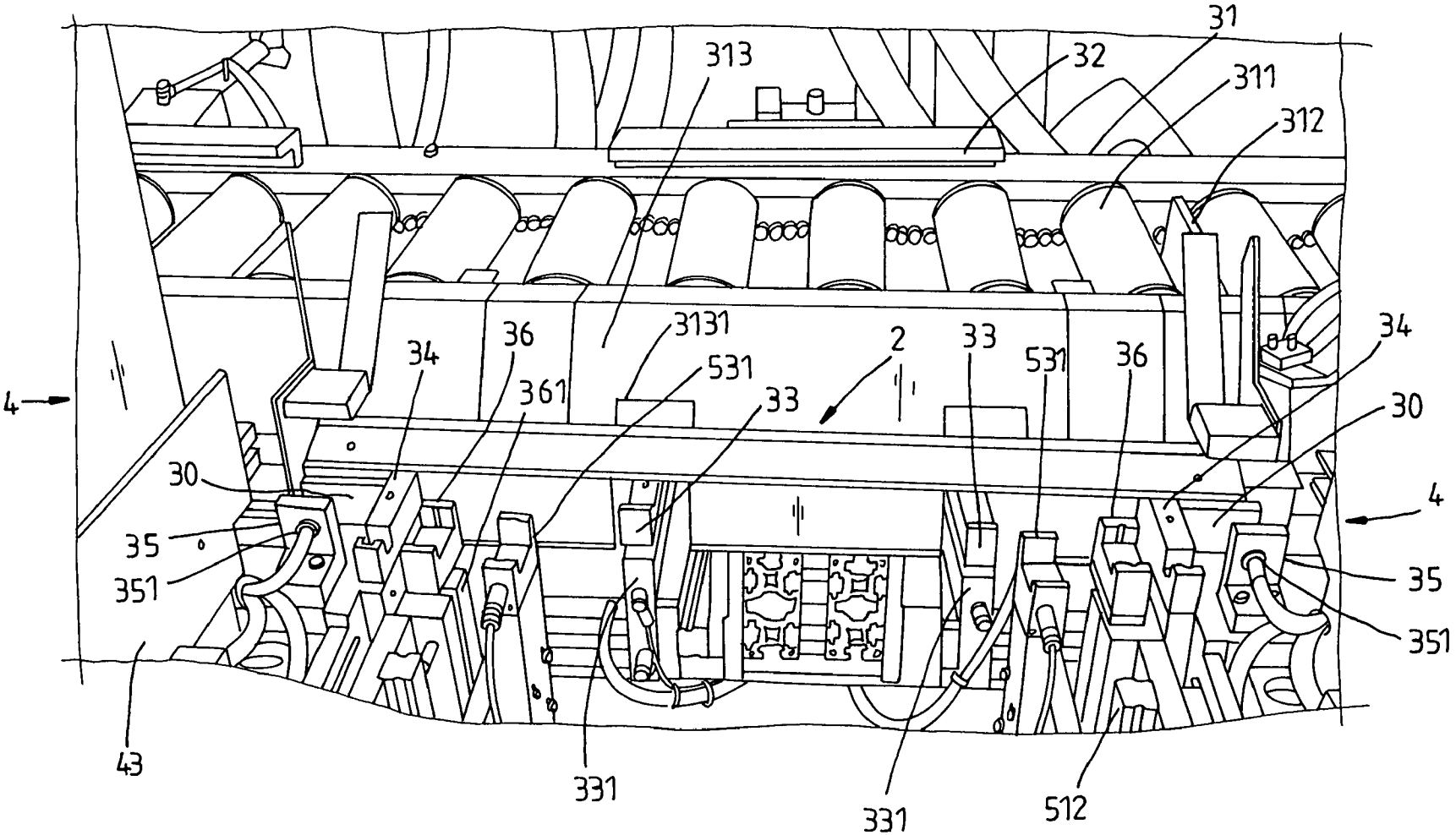
FIG. 18 corresponds to FIG. 17, showing still another action of the T-bracket and spring plate riveting machine.
Figure 19:
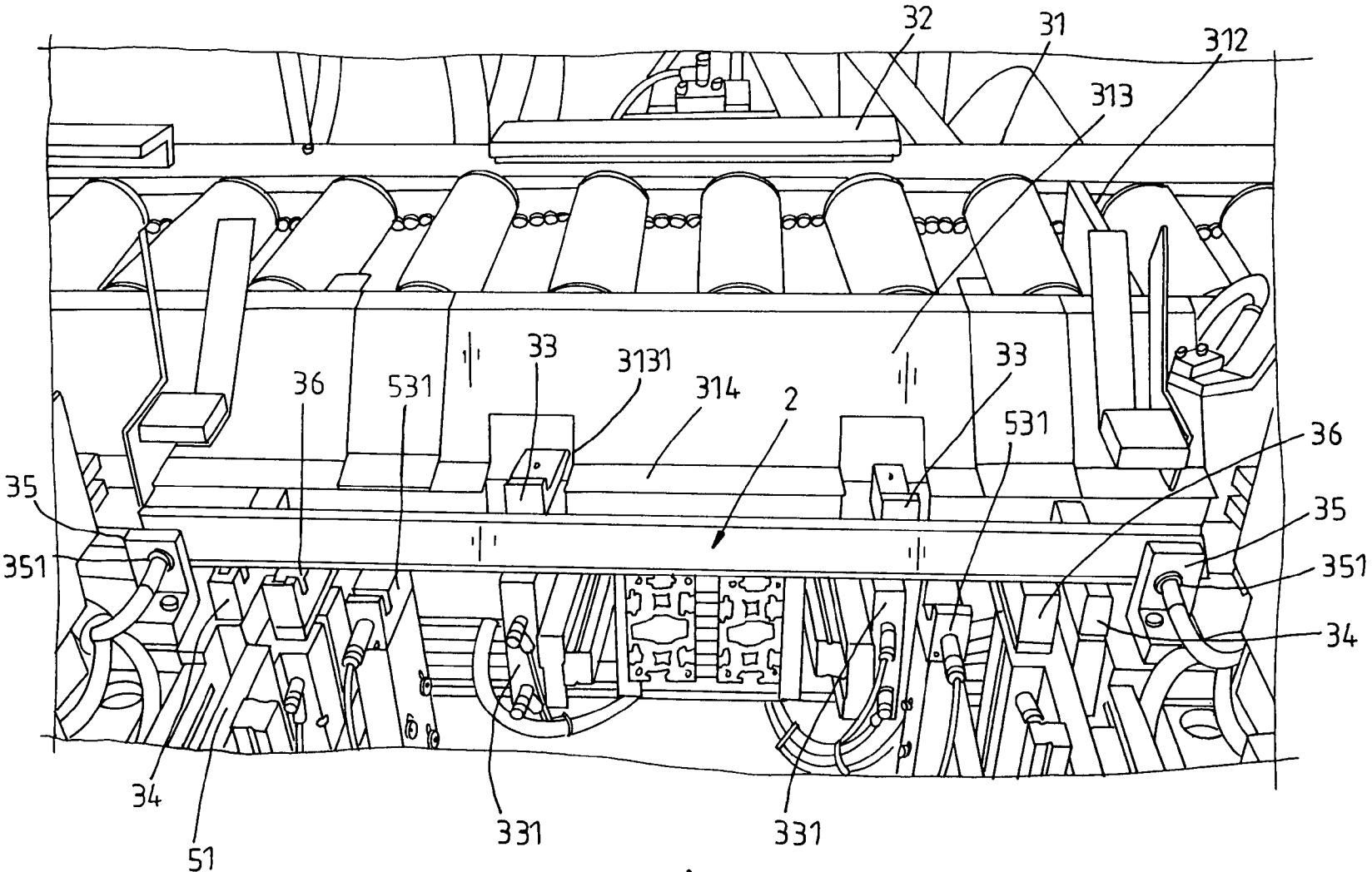
FIG. 19 corresponds to FIG. 18, showing still another action of the T-bracket and spring plate riveting machine.
Figure 20:
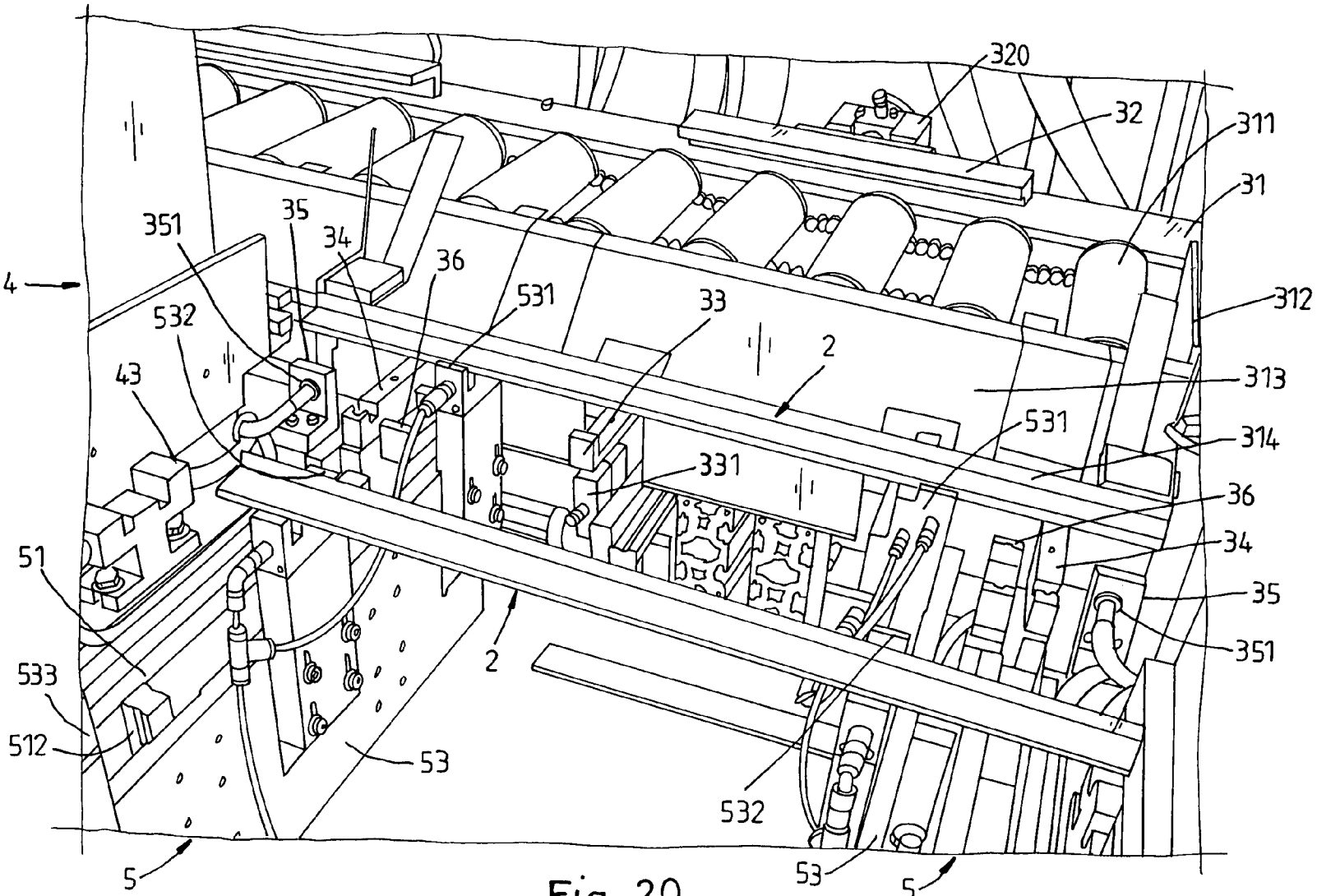
FIG. 20 corresponds to FIG. 19, showing still another action of the T-bracket and spring plate riveting machine.
Figure 21:
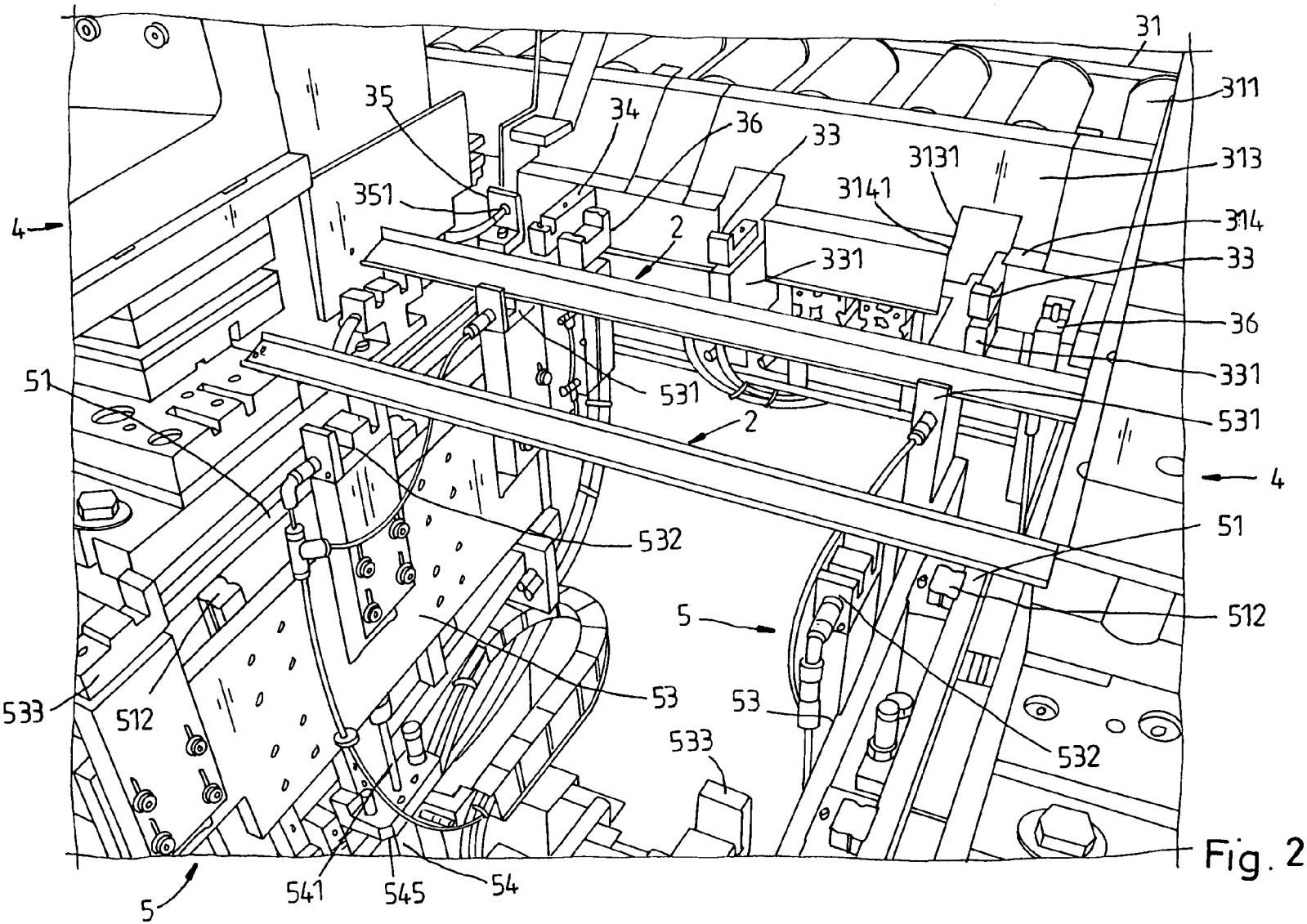
FIG. 21 corresponds to FIG. 20, showing still another action of the T-bracket and spring plate riveting machine.
Figure 22:
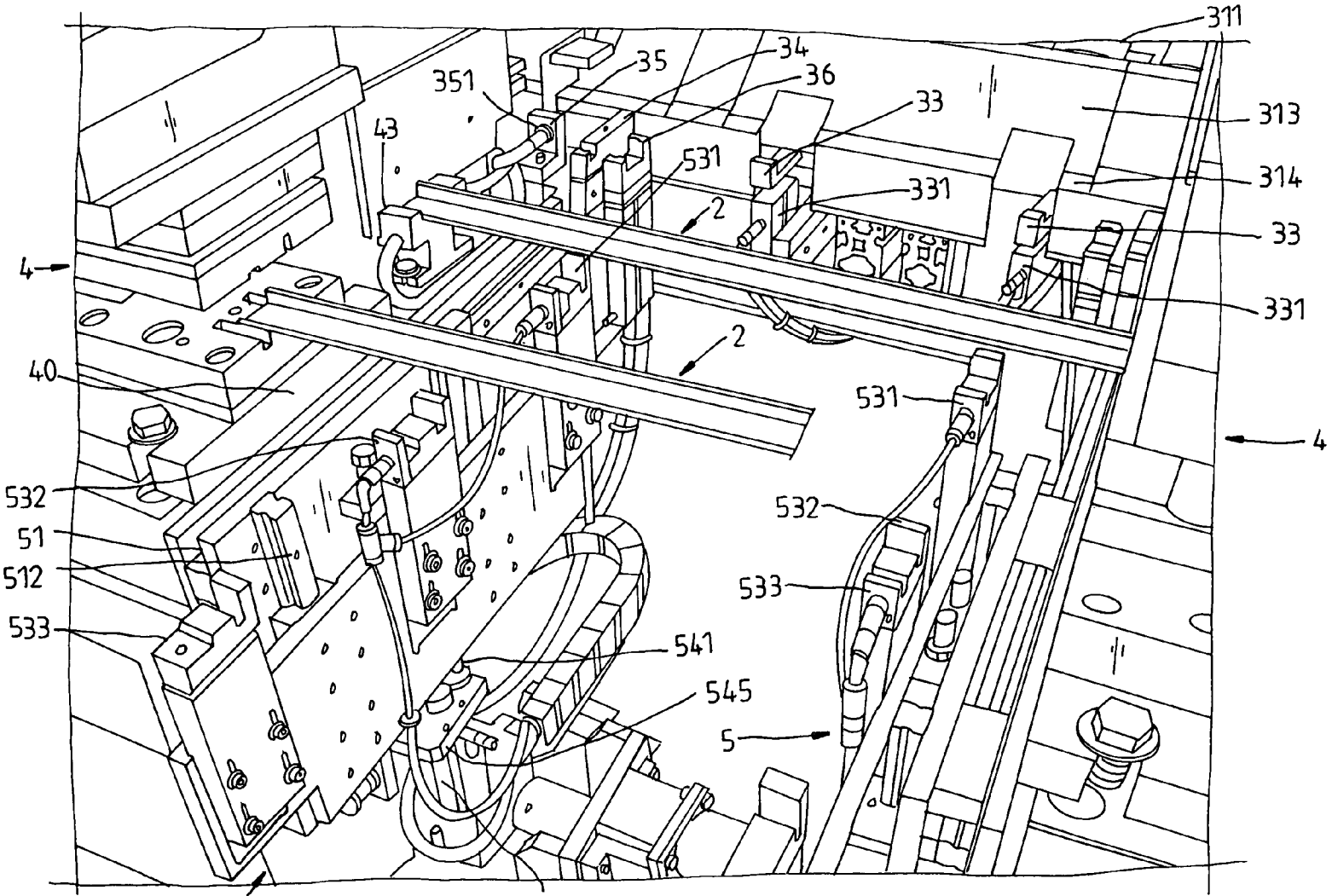
FIG. 22 corresponds to FIG. 21, showing still another action of the T-bracket and spring plate riveting machine.
Figure 23:
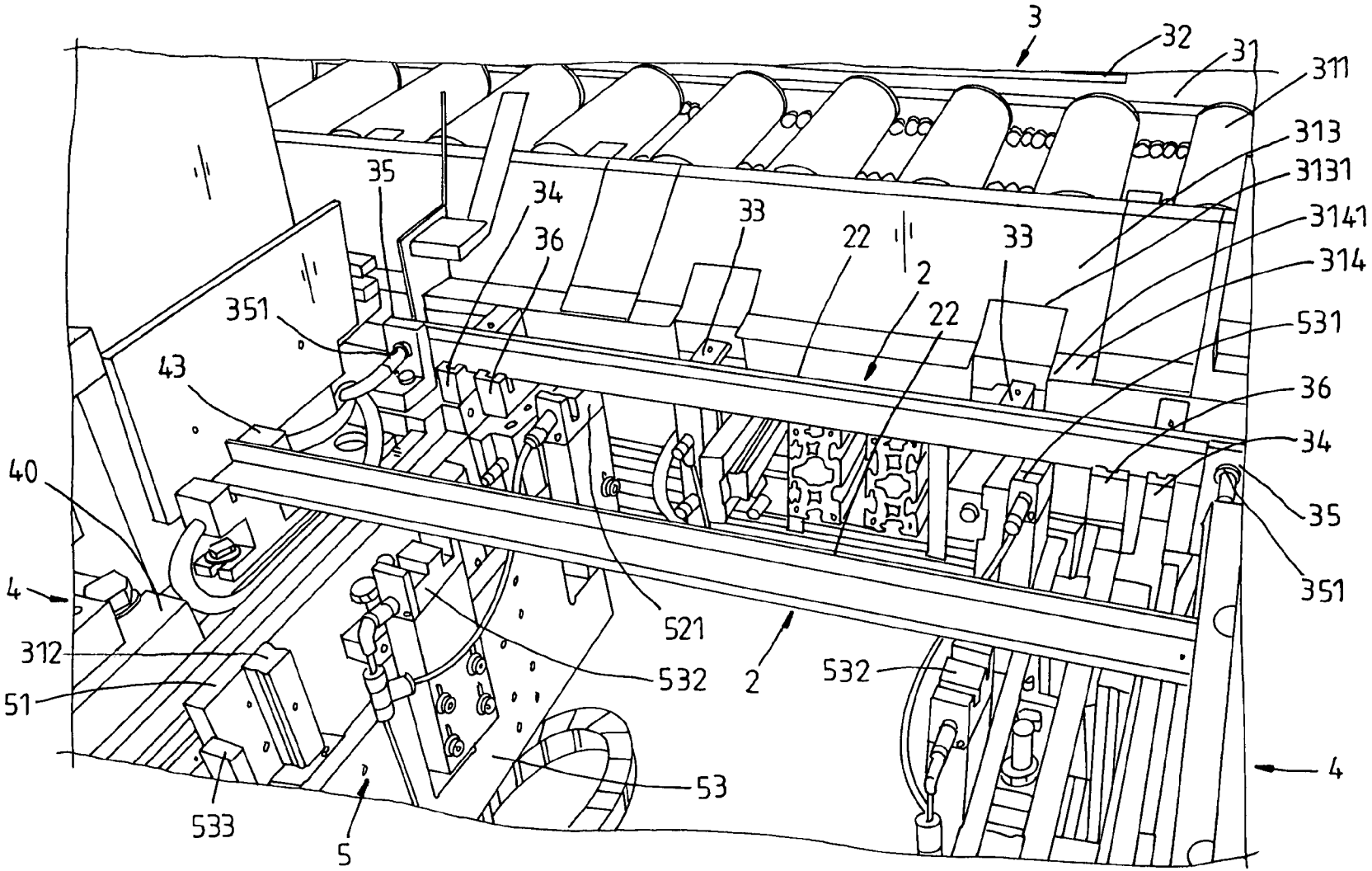
FIG. 23 is a schematic drawing of the present invention, showing the T-bracket received at the receiver frames in a wrong direction.
Figure 25:
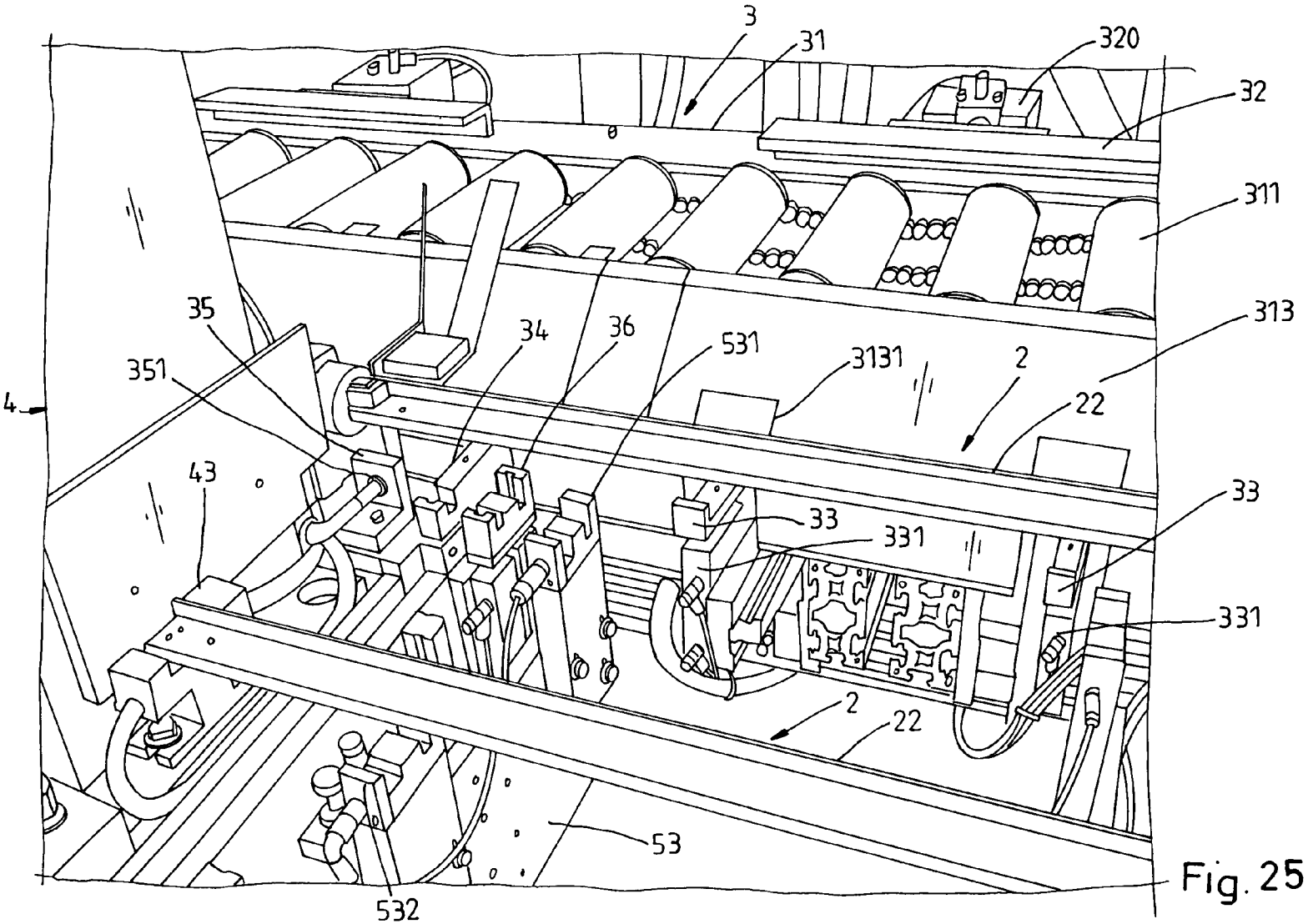
FIG. 25 corresponds to FIG. 24, showing the incorrectly positioned T-bracket reversed.
Figure 26:
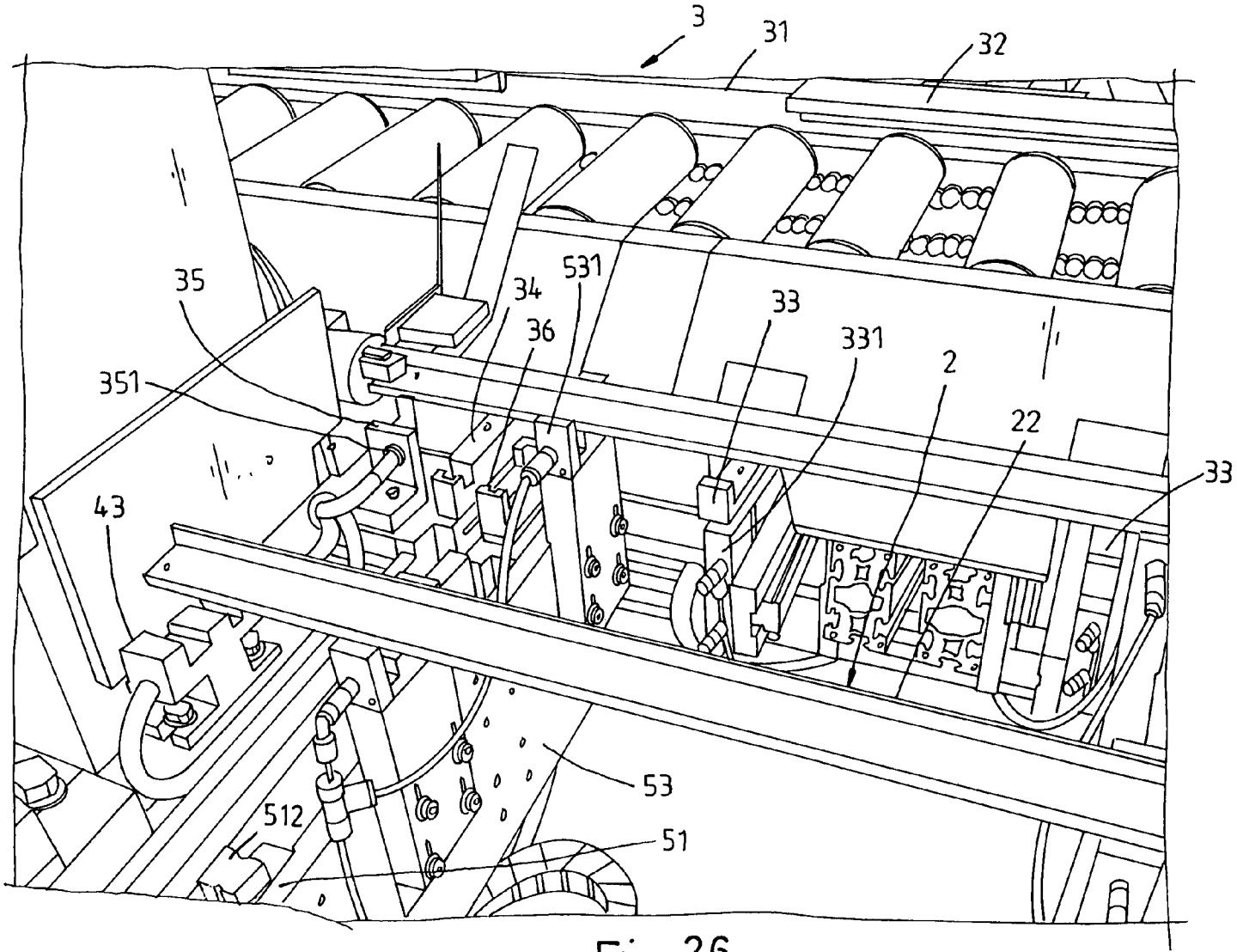
FIG. 26 corresponds to FIG. 25, showing the direction of the T-bracket corrected, the work frame units lowered.

Referring to FIG. 16, when the conveyer 31 carried a T-bracket 2 to the stop block 312, the sensors 351 detect the presence of the T-bracket 2 and control the first air cylinders 320 to extend out the reciprocating rods 3201 and to further push the conveyed T-bracket 2 away from the conveyer 123 to the collector frame 314 at the bottom side of the sloping wall 313 (see FIG. 17), enabling the T-bracket 2 to be stopped at the material stopper frames 30. Thereafter, the second air cylinders 300 are controlled to move the material stopper frames 30 downward (see FIG. 18) from the T-bracket 2, and then the third air cylinders 331 are controlled to extend out the respective vertically extending reciprocating rods 3311 and to lift the T-bracket 2 to the top side of the receiver frames 34, and then the third air cylinders 331 are controlled to retract the reciprocating rods 3311 for enabling the T-bracket 2 to be received by the receiver frames 34 (see FIG. 19) with the top wall 22 engaged into the positioning slot 341 of the receiver frames 34. At this time, the sensors 351 of the sensor holders 35 detect the position of the T-bracket 2 at the receiver frames 34. When the position of the T-bracket 2 is checked to be correct, the vertical driving cylinder 54 of each work frame unit 5 is controlled to move the second frame 53 upwards and to drive the first bearing frame 531 to lift the respective receiver frame 34 and the T-bracket 2. At the same time, the third bearing frames 533 lift the finished product 2' that has the spring plates 601 riveted thereto. Thereafter, the horizontal driving cylinders 52 of the work frame units 5 are controlled to move the respective base frames 51 and the respective second frames 53 outwards (see FIG. 21). Thereafter, the vertical driving cylinders 54 of the work frame units 5 are controlled to lower the respective reciprocating rods 541 (see FIG. 22), enabling the T-bracket 2 to be moved from the first bearing frames 531 to the supplementary frames 43 for riveting. The finished product 2' is then received by the top receiving face 71 of the collector frame 7, and guided by the sloping guide face 72 to the collector base 73. At final, the horizontal driving cylinders 52 of the work frame units 5 are controlled to move the respective base frames 51 and the respective second frames 53 back to their former positions for another processing cycle. If the T-bracket 2 is received at the receiver frame 34 in a wrong direction (see FIG. 23), the signal of the sensors 351 of the sensor holder 35 will be blocked by the top wall 22 of the T-bracket 2, and at this time the fifth air cylinders 361 can be controlled to move the corrector frames 36 to lift the T-bracket 2 at the receiver frames 34 (see FIG. 24). Thereafter, the reciprocating devices 38 are controlled to move the rotary drives 37 and to drive the chucks 372 to catch the T-bracket 2, and then the rotary drives 37 are rotated through 180° to correct the T-bracket 2 to the correct position (see FIG. 25). After correction of the position of the T-bracket 2, the horizontal driving cylinders 52 are controlled to move the work frame units 5 inwards, and then the vertical driving cylinders 54 are controlled to lift the work frame units 5 to the position where the first bearing frames 531 of the second frames 53 are moved to the bottom side of the correctly positioned T-bracket 2. Thereafter, the chicks 372 of the rotary drives 37 are released from the T-bracket 2, and the reciprocating devices 38 are controlled to return the rotary drives 37, and the vertical driving cylinders 54 are controlled to lift the work frame units 5, allowing the first bearing frames 531 to receive the T-bracket 2 (see FIG. 26). At the same time, the second bearing frames 532 are moved to lift the T-bracket 2, and the third bearing frames 533 are moved to lift the finished product 2'. Thereafter, the horizontal driving cylinders 52 are controlled to move the second frames 53 outwards, and the vertical driving cylinders 54 are lowered, enabling the T-bracket 2 to be moved from the first bearing frames 531 to the supplementary frames 43 for riveting by the stamping mold 40. The finished product 2' will then be received by the top receiving face 71 and then guide by the sloping guide face 72 to the collector base 73. At final, the horizontal driving cylinders 52 are controlled to return the base frames 51 and second frames 53 of the work frame units 5.

As indicated above, the invention has the following advantages:

1. The T-bracket 2 made by the T-bracket making machine 1 is directly delivered forwards to the T-bracket and spring plate riveting machine 3 and automatically riveted with spring plates 601 by the T-bracket and spring plate riveting machine 3.

2. If the T-bracket 2 is not received at the receiver frames 34 in the correct position, the sensor holders 35 will control the corrector frames 36 to lift the T-bracket 2 from the receiver frames 34 and the rotary drives 37 to catch the T-bracket 2 and to reverse the T-bracket 2 to the correct position, enabling the correctly positioned T-bracket 2 to be further received by the first bearing frames 531 of the second frames 53 of the work frame units 5 for further riveting processing correctly without shutting down the machine.

3. The pitch between the two riveting units 4 is adjustable to fit different sizes of T-brackets 2 and spring plates 601.

What is claimed is:

1. A T-bracket and spring plate riveting machine used with a T-bracket making machine and controlled to rivet two spring plates to the two distal ends of each T-bracket received from the T-bracket making machine, said T-bracket making machine comprising a blank bracket body making unit and a bracket processing unit, said blank bracket body making unit being controlled to process a metal plate material into a blank bracket body, said bracket processing unit comprising a base, a work table, and a conveying mechanism, said conveying mechanism being provided at a top side of said base and adapted to carry a blank bracket body from said blank bracket body making unit forwards for processing, said work table being movably provided at a top side of said base over said conveying mechanism and having a stamping mechanism adapted to process the received blank bracket body into a T-bracket for processing by said T-bracket and spring plate riveting machine, said T-bracket and spring plate riveting machine comprising:

a conveyer, which comprises a plurality of transversely extending rollers adapted to carry a T-bracket from said bracket processing unit forward for processing, a stop block at one end thereof remote from said bracket processing unit, a sloping wall at one lateral side near said stop block, a collector frame at a bottom side of said sloping wall, a first bottom frame, and a second bottom frame;

two first air cylinders provided at one lateral side of said conveyer opposite to said sloping wall;

two material push bars respectively fastened to the reciprocating rods of said first air cylinders and movable with the reciprocating rods to push the conveyed T-bracket away from said conveyer to said collector frame at a bottom side of said sloping wall;

sensors provided at said conveyer and adapted to detect the presence of a T-bracket at said conveyer and to control the operation of said first air cylinders subject to the detection result;

two second air cylinders respectively fixedly provided at the first bottom frame of said conveyer and controlled to move a respective reciprocating rod forwards and backwards;

two material stopper frames respectively fixedly fastened to the reciprocating rods of said second air cylinders and movable with the reciprocating rods of said second air cylinders for stopping the received T-bracket at said collector frame;

a plurality of third air cylinders, said third air cylinders each having a vertically extending reciprocating rod;

a plurality of carriers respectively fixedly fastened to the reciprocating rods of said third air cylinders below respective openings at said collector frame;

rails provided at one side relative to said third air cylinders;

sliding blocks respectively provided at the second bottom frame of said conveyer and coupled to said rails;

a plurality of fourth air cylinders fastened to one side of said second bottom frame of said conveyer, said fourth air cylinders each having a respective reciprocating rod respectively connected to said third air cylinders for moving said third air cylinders horizontally inwards/outwards two riveting units, each said riveting unit comprising a pair of longitudinal rails, a pair of transverse rails, a stamping mold for stamping a metal sheet material into spring plates and riveting spring plates to T-brackets, and a locating plate;

two receiver frames respectively fixedly fastened to the locating plates of said riveting units for receiving the T-bracket carried by said carriers, each said receiver frame having a positioning slot for holding a part of the T-bracket in proximity to two sensor holders;

two sensor holders, each sensor holder having a sensor for detecting the position of a T-bracket at said receiver frames and for driving two corrector frames to correct the position of the T-bracket if the T-bracket is carried on said receiver frames in a wrong direction;

two corrector frames adapted to correct the position of the T-bracket at said receiver frames, each said corrector frame having a slot for receiving the T-bracket;

two fifth air cylinders respectively fixedly mounted on said riveting units, each said fifth air cylinder having a reciprocating rod respectively connected to said corrector frames for moving said corrector frames to correct the position of the T-bracket at said receiver frames;

two rotary drives fixedly fastened to a respective holder frame, which has a coupling slidably coupled to the longitudinal rails at said riveting units and is movable by a reciprocating device along the longitudinal rails at said riveting units, each said rotary drive comprising a rotary head rotatable through 180° within two reversed directions, and a chuck provided at said rotary head for clamping the workpiece;

two work frame units, each said work frame unit comprising a base frame, a slide fixedly provided at a back side of said base frame and coupled to the transverse rails at said riveting units, a connecting block fixedly provided at a bottom side pf said base frame, a horizontal driving cylinder, which has a reciprocating rod connected to said connecting block for moving said base frame along said transverse rails, a pair of vertical rails fixedly provided at a front side of said base frame, a second frame, a slide fixedly provided at a back side of said second frame and coupled to said vertical rails, a vertical driving cylinder, which has a locating block connected to the connecting block of said base frame and a reciprocating rod connected to a bottom side of said second frame for moving said second frame along said vertical rails, and three bearing frames including a first bearing frame, a second bearing frame and a third bearing frame respectively fastened to a front side of said second frame and arranged in parallel, which bearing frames each having a locating opening for the positioning of the T-bracket;

two supplementary frames respectively fastened to said riveting units at two sides for receiving the T-bracket from said second bearing frames of said work frame units, each said supplementary frame having a locating opening for the positioning of the received bracket; and two material feeders adapted to feed a respective roll of metal sheet material to the stamping mold of each said riveting unit for stamping into spring plates for riveting to the received T-bracket to form the desired finished product.

2. The T-bracket and spring plate riveting machine as claimed in claim 1, wherein said conveyer has a curved front guide board for guiding the T-bracket forwards for processing.

3. The T-bracket and spring plate riveting machine as claimed in claim 1, wherein said two riveting units includes a first riveting unit and a second riveting unit, said first riveting unit having a bottom side connected to a bottom frame, said second riveting unit having a slide fixedly provided at a bottom side thereof and coupled to a pair of rails at the bottom frame to which said first riveting unit is connected, a guide block fixedly provided at the bottom side, a screw rod threaded through said guide block, said screw rod having a first end threaded into a locating block and a second end coupled to a speed-reduction motor for turning by said speed-reduction motor to move said guide block of said second riveting unit along the rails at the bottom frame to which said first riveting unit is connected and to further adjust the distance between said first riveting unit and said second riveting unit.

4. The T-bracket and spring plate riveting machine as claimed in claim 1, further comprising a collector frame is provided at one side relative to said riveting units, said collector frame having a top receiving face, a sloping guide face extending from one side of said top receiving face, a plurality of openings transversely cut through said top receiving face and extending to said sloping guide face at a distance for receiving said third bearing frames of said second frames of said work frame units for enabling the T-bracket to be received by said top receiving face upon down stroke of said third bearing frames relative to said collector frame, and a collector base at a bottom side of said sloping guide face.

* * * * *